US006692287B2

(12) United States Patent
Yasuda

(10) Patent No.: US 6,692,287 B2
(45) Date of Patent: Feb. 17, 2004

(54) CONNECTOR

(75) Inventor: Nobuyuki Yasuda, Chiba (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/169,629

(22) PCT Filed: Nov. 9, 2001

(86) PCT No.: PCT/JP01/09842

§ 371 (c)(1),
(2), (4) Date: Oct. 15, 2002

(87) PCT Pub. No.: WO02/39551

PCT Pub. Date: May 16, 2002

(65) Prior Publication Data

US 2003/0060081 A1 Mar. 27, 2003

(30) Foreign Application Priority Data

Nov. 10, 2000 (JP) ..... 2000-349334

(51) Int. Cl.[7] ..... K01R 13/627
(52) U.S. Cl. ..... 439/352
(58) Field of Search ..... 439/352, 353, 439/357, 358

(56) References Cited

U.S. PATENT DOCUMENTS 5,233,674 A * 8/1993 Vladic ..... 385/56
5,603,631 A * 2/1997 Kawahara et al. ..... 439/352
6,319,042 B2 * 11/2001 Hirschmann ..... 439/352
6,464,403 B1 * 10/2002 Koch et al. ..... 385/53
6,464,526 B1 * 10/2002 Seufert et al. ..... 439/352
6,511,339 B1 * 1/2003 Huang ..... 439/353
6,517,373 B2 * 2/2003 Finke et al. ..... 439/352

* cited by examiner

*Primary Examiner*—Tulsidas Patel
(74) *Attorney, Agent, or Firm*—Jay H. Maioli

(57) ABSTRACT

A connection device including a plug unit (P) which has a connector plug (3) provided at an end portion of a signal cable and a receptacle unit (R) in which the plug unit (P) is inserted. The plug unit (P) has an unlocking member (4) supported on an outer circumferential surface of the connector plug (3) so as to be movable in the axial direction of the cable (2) and has a knob portion (12) mounted thereon. The receptacle unit (R), in which the plug unit (P) can be inserted and removed, has a lock member (5) housed in the receptacle unit (R) and adapted for being engaged with the connector plug (3) to lock the plug unit (P) and controlled by movement of the unlocking member (4) in the axial direction of the cable (2) via a cam portion (40) (41) provided on an outer circumferential surface of the unlocking member (4), thus locking and unlocking the connector plug (3) inserted in the receptacle unit (R).

17 Claims, 24 Drawing Sheets

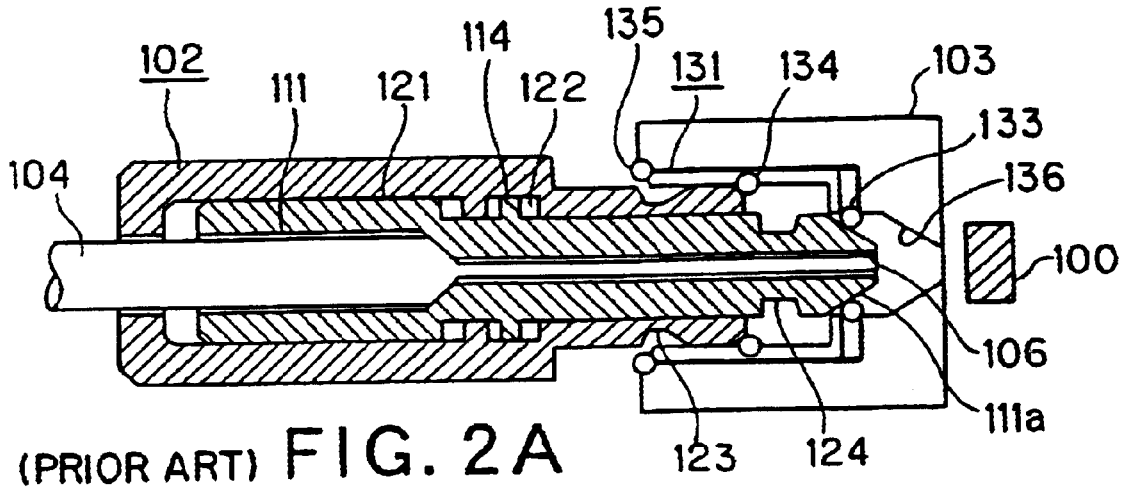
(PRIOR ART) FIG. 2A
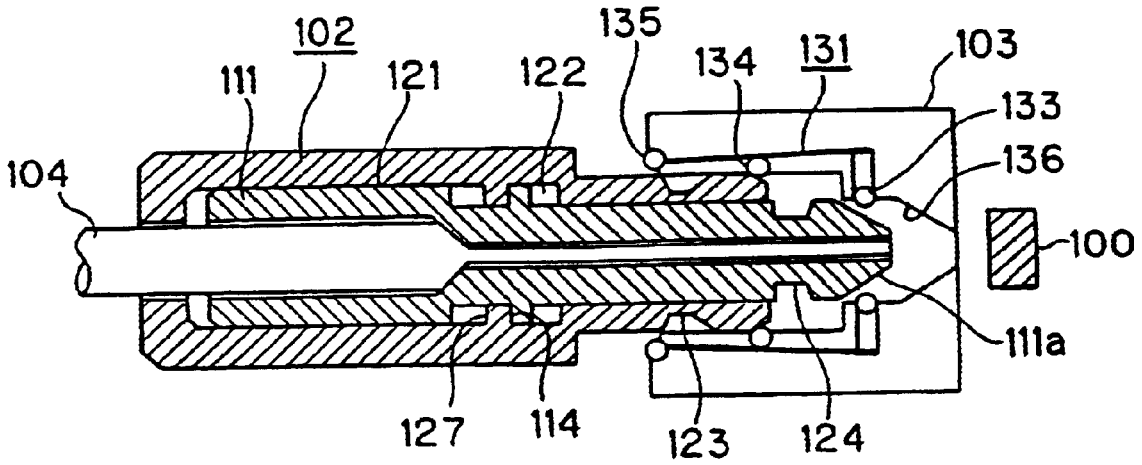
(PRIOR ART) FIG. 2B
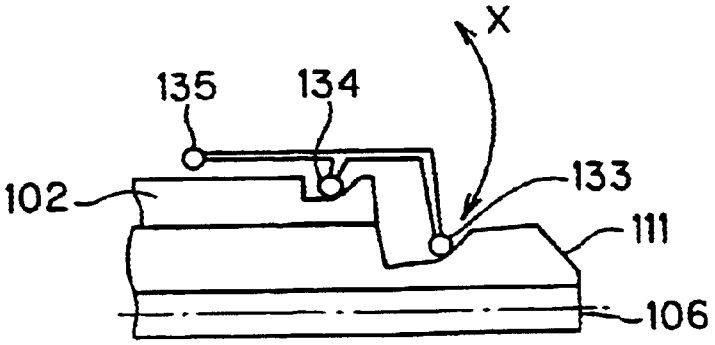
(PRIOR ART) FIG. 3

CONNECTOR

TECHNICAL FIELD

This invention relates to a connection device for connecting an electronic equipment and a signal cable, and particularly to a connection device having a connecting plug and a connecting jack and adapted for connecting a signal cable to an electronic equipment by inserting the connecting plug into the connecting jack.

BACKGROUND ART

Conventionally, in order to connect a plurality of electronic equipments to enable transmission and reception of signals, a dedicated signal cable is used and a connector is used for connecting a signal cable and an electronic equipment. The connection device of this type connects the signal cable and the electronic equipment by usually inserting a plug or jack mounted at the end of the signal cable into a jack or plug provided on the equipment.

Recently, as a signal cable used for connecting various types of electronic equipments, not only an electric signal cable, which has been well known conventionally, but also an optical signal cable or the like for transmitting information by using light is used.

An equipment for transmitting information between electronic equipments by using light is described in the European Laid-Open Patent Application 0430107A2. A connection device which enables easy connection between a connecting plug and a connecting jack and easy disconnection thereof is described in the specification of the U.S. Pat. No. 4,540,236.

An exemplary connection device used for transmitting information between electronic equipments by using an optical signal cable will now be described.

In this connection device, a jack 103 is provided on the side of an electronic equipment 105, and a plug 102 to be inserted and fitted in the jack 103 is mounted on both ends of an optical cable 104, as shown in FIG. 1.

When the plug 102 is inserted into a receiving hole of the jack 103, a core 106 of the optical cable 104 provided at the center of the plug 102 faces an optical element 100 provided within the electronic equipment 105. The jack installed in the electronic equipment 105 is called receptacle.

Referring to FIGS. 2A and 2B showing schematic cross-sectional views of the structure of the plug and the receptacle, a typical connection state will be described.

A plug 102 shown in FIG. 2A has a substantially cylindrical plug body 111 mounted at the distal end of an optical cable 104, which is a signal cable for connecting a plurality of electronic equipments 105, and holding a core 106 of an optical fiber at the central axial core, and an unlocking member 121 fitted on the outer circumference of the plug body 111 so as to be movable in the axial direction of the plug body 111. As a ring-shaped engagement piece 114 is projected on the outer circumferential surface of the plug body 111 is situated in a void 122, the plug body 111 and the unlocking member 121 are movable with respect to each other in the axial direction of the plug 102 within the spatial range in the void 122.

As for a jack 103 installed on the equipment side, a tapered hole 136 to fit with a tapered portion 111*a* formed at the distal end of the plug body 111 is opened at the center, and the core 106 provided at the center of the inserted plug 102 and an optical element 100 installed in the equipment are maintained at predetermined positions and arranged to face each other at a constant distance from each other.

A plurality of lock members 131 for holding the plug 102 inserted in the jack 103 are housed in the jack 103. The lock member 131 is supported in the jack 103 via a pivotal point portion 135 and is supported to be rotatable about the pivotal point portion 135 into the direction orthogonal to the direction of inserting the plug 102. The lock member 131 has a press operator 134 projected at its center, and a plug engagement pawl 133 protruding toward plug 102 inserted in the jack 103 is formed at the right end in FIGS. 2A and 2B.

The plug 102 in this example is inserted into the jack 103 as the unlocking member 121 movable with respect to the plug body 111 is held by a hand. Therefore, when the plug 102 is inserted halfway in the jack 103, an abutment piece 127 protruding inside the unlocking member 121 is abutted against the engagement piece 114 of the plug body 111, as shown in FIG. 2B. That is, the unlocking member 121 is moved rightward in FIG. 2B relatively to the plug body 111.

As the plug 102 is inserted further into the jack 103 and the tapered portion 111*a* formed at the distal end of the plug body 111 is inserted and fitted in the tapered hole 136 provided at the center of the jack 103, the center of the core 106 is aligned with the center of the optical element 100 installed in the equipment. Thus, the insertion of the plug 102 in the jack 103 is completed.

When the plug 102 is inserted, the press operator 134 of the lock member 131 provided in the jack 103 is pressed by the unlocking member 121, and the plug engagement pawl 133 on the distal end side is rotated about the pivotal point portion 135 into the direction away from the inserted plug body 111, as shown in FIG. 2B.

As the plug 102 is further and fully inserted into the jack 103, the lock member 131 is rotated back to the inserted plug 102. The plug engagement pawl 133 is engaged with an engagement groove 124 formed at the distal end of the plug body 111, and the press operator 134 is engaged with a cam groove 123 formed at a halfway part of the plug body 111.

By being engaged with the engagement groove 124, the plug engagement pawls 133 hold the plug body 111 between them, and hold the inserting position of the plug body 111 to the jack 103, thus preventing detachment of the plug 102 when an external tension is applied to the optical cable 104.

In the case of extracting the plug 102 from the jack 103, the unlocking member 121 is moved leftward in FIGS. 2A and 2B along the axial direction of the optical cable 104. When the unlocking member 121 is moved leftward in FIGS. 2A and 2B, the press operator 134 provided at a halfway part of the lock member 131 is guided by the cam groove 123 to move to the outer circumferential surface of the unlocking member 121. The plug engagement pawl 133 of the lock member 131 is rotated about the pivotal point portion 135 into the direction away from the plug body 111, thus unlocking the plug body 111.

The junction part between the plug 102 and the jack 103 is the optical connecting part between the core 106 of the optical cable 104 and the optical element 100 inside the equipment. As the plug 102 is inserted, the core 106 of the optical cable 104 on the side of the plug 102 faces the optical element 106 on the equipment side. In order to minimize the transfer loss at the connecting part, the axial cores of the optical cable 104 and the optical element 100 must be aligned with each other with high accuracy and a constant distance must be maintained between the distal end surfaces of the optical element 100 and the optical cable 104.

The above-described structure for engagement and holding of the plug body 111 by the plug engagement pawl 133 of the lock member 131 is provided in order to prevent movement of the end surface of the optical cable 104 after the connection between the plug 102 and the jack 103 and to optimize the transfer characteristic of the optical cable 104.

In consideration of the structure, the position of the pivotal point portion 135 of the lock member 131 must be away to a certain extent from the center of the optical element 100, which is the axial core of the jack 103. As shown in FIG. 3, which is a schematic view of this state, the lock member 131 is rotated about the pivotal point portion 135 as the center of rotation and therefore the plug engagement pawl 133 moves along a locus indicated by X in FIG. 3. The distal end of the plug engagement pawl 133 has a gentle arcuate surface to avoid interference with the plug body 111. Therefore, an external force tends to generate a certain slack in the tapered portion, which is the junction between the plug 102 and the jack 103 and a change in the external tension may cause variance in the distance between the optical element 100 and the optical cable 104 and shift of the axial core. Moreover, if a large external force is applied to the optical cable, the plug 102 may fall out from the jack 103.

Meanwhile, in most cases, a connector provided on an electronic equipment is generally arranged at a position that cannot be easily seen by a user, for example, on the back side of the equipment, in order to keep good appearance of the electronic equipment. It is desired that the insertion/extraction of the connector can be easily carried out. Adding a fixing operation to the inserting/extracting operation is not desired by users.

The popularization of information equipments involves connection of a plurality of electronic equipments for use via signal cables such as optical cables. In this case, since many signal cables are used for connecting equipments. If, for example, one of the many signal cables is detached for a certain reason, it is difficult to search for that signal cable. Therefore, it is desired that the connecting part using a plug and a jack has a structure such that no detachment occurs even if a certain external force is applied to the signal cable.

In the above-described connection device, the distance in the direction of the axial core between the end surface of the optical cable and the optical element on the jack side tends to vary and the variance in the signal transfer characteristic cannot be disregarded. Therefore, characteristic problems arise.

DISCLOSURE OF THE INVENTION

In view of the foregoing status of the art, it is an object of the present invention to provide a connection device which can securely maintain a connecting state of a signal cable to an electronic equipment.

It is another object of the present invention to provide a connection device which can hold an accurate connecting position of a connecting plug to a jack and can maintain a good signal transfer characteristic.

A connection device according to the present invention includes a plug unit which has a connector plug provided at an end portion of a signal cable and an unlocking member supported on an outer circumferential surface of the connector plug so as to be movable in the axial direction of the cable and having a knob portion mounted thereon, and a receptacle unit in which the plug unit can be inserted and removed, wherein a lock member housed in the receptacle unit and adapted for being engaged with the connector plug to lock the plug unit is controlled by movement of the unlocking member in the axial direction of the cable via a cam portion provided on an outer circumferential surface of the unlocking member.

When the lock member used in this device is rotationally controlled by the movement of the unlocking member, the lock member is housed in a lock member housing portion provided in the receptacle unit, with its pivotal point position made movable.

The lock member for locking the connector plug is energized by an elastic member for providing an energizing force in a direction parallel to the axial direction of the cable and an energizing force in a direction perpendicular to the axial direction of the cable.

As the elastic member for energizing the lock member, a plate-like Z spring molded integrally with the lock member is used.

Alternatively, a Z spring formed by bending a thin plate in a Z-shape may be used as the elastic member.

The connector plug constituting the plug unit has a tapered portion provided as its distal end, the tapered portion being engaged with a tapered portion on the receiving side provided in the receptacle unit.

The lock member has a plug engagement pawl provided at its distal end, the plug engagement pawl being engaged with the connector plug. The plug engagement pawl is elastically displaceable.

An optical cable is used as the signal cable.

The other objects and advantages of the present invention will be clarified further from the specific structure, which will be described hereinafter with reference to the drawings.

BRIEF DESCRIPTION OF THE DRAWINGS

FIGS. 2A and 2B are cross-sectional views showing a connection device with a plug lock function which has been conventionally used.

FIG. 3 is a side view showing the operating state of a lock mechanism of the conventional connection device.

FIG. 11A is a side view showing the state where no load is applied to the Z spring, and FIG. 11B is a side view showing the state where the Z spring is housed and compressed in the receptacle.

FIG. 12A is a side view showing the state where no load is applied to the Z spring, and FIG. 12B is a side view showing the state where the Z spring is housed and compressed in the receptacle.

FIG. 13A is a side view showing the state where no load is applied to the spring, and FIG. 13B is a side view showing the state where the spring is housed and compressed in the receptacle.

BEST MODE FOR CARRYING OUT THE INVENTION

Preferred embodiments of the connection device according to the present invention will now be described in detail with reference to the drawings.

Figure 1:
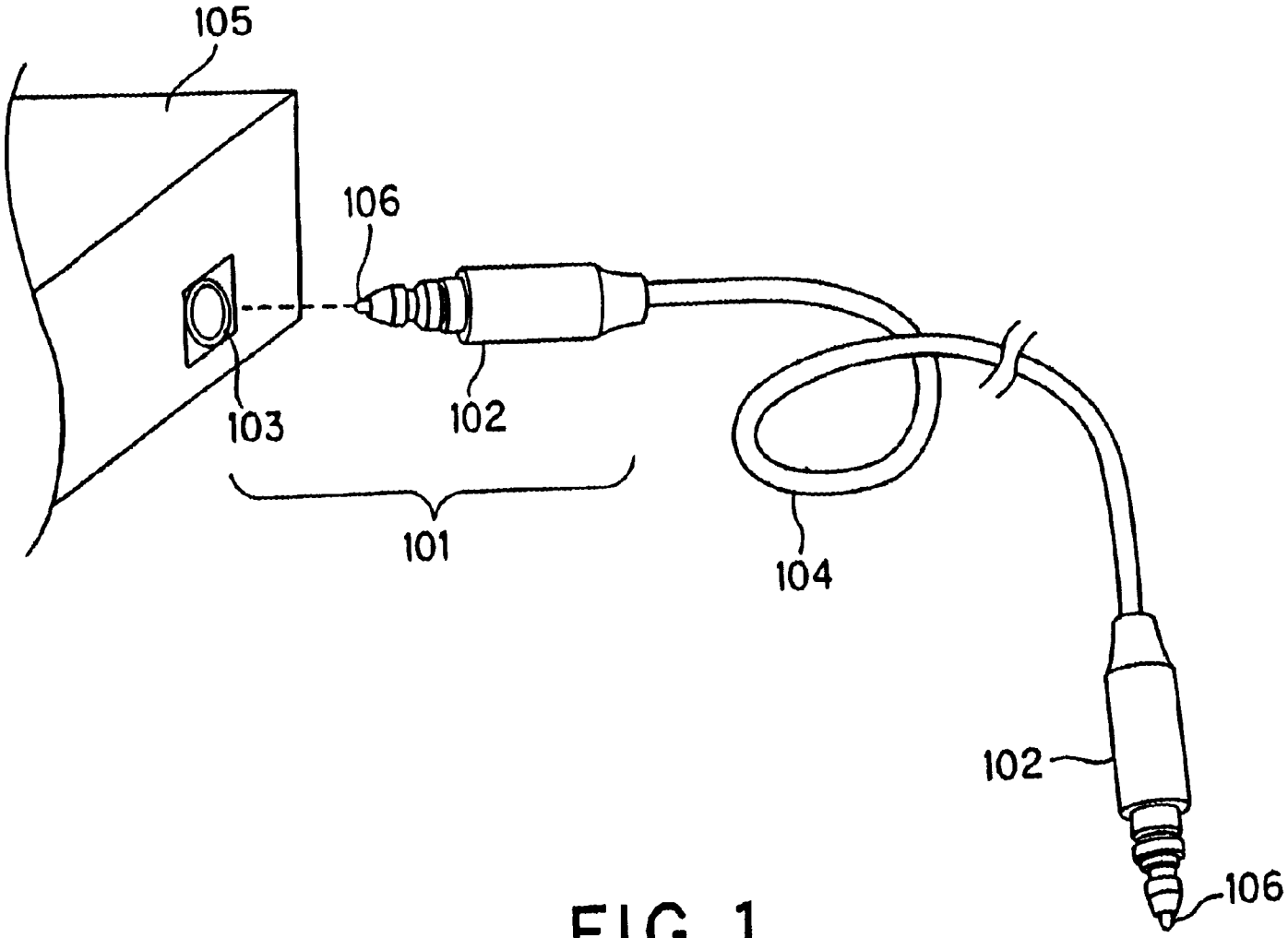
FIG. 1 (PRIOR ART)
FIG. 1 is a perspective view showing a jack installed on the side of an electronic equipment and a plug provided at an end of an optical cable.
Figure 4:
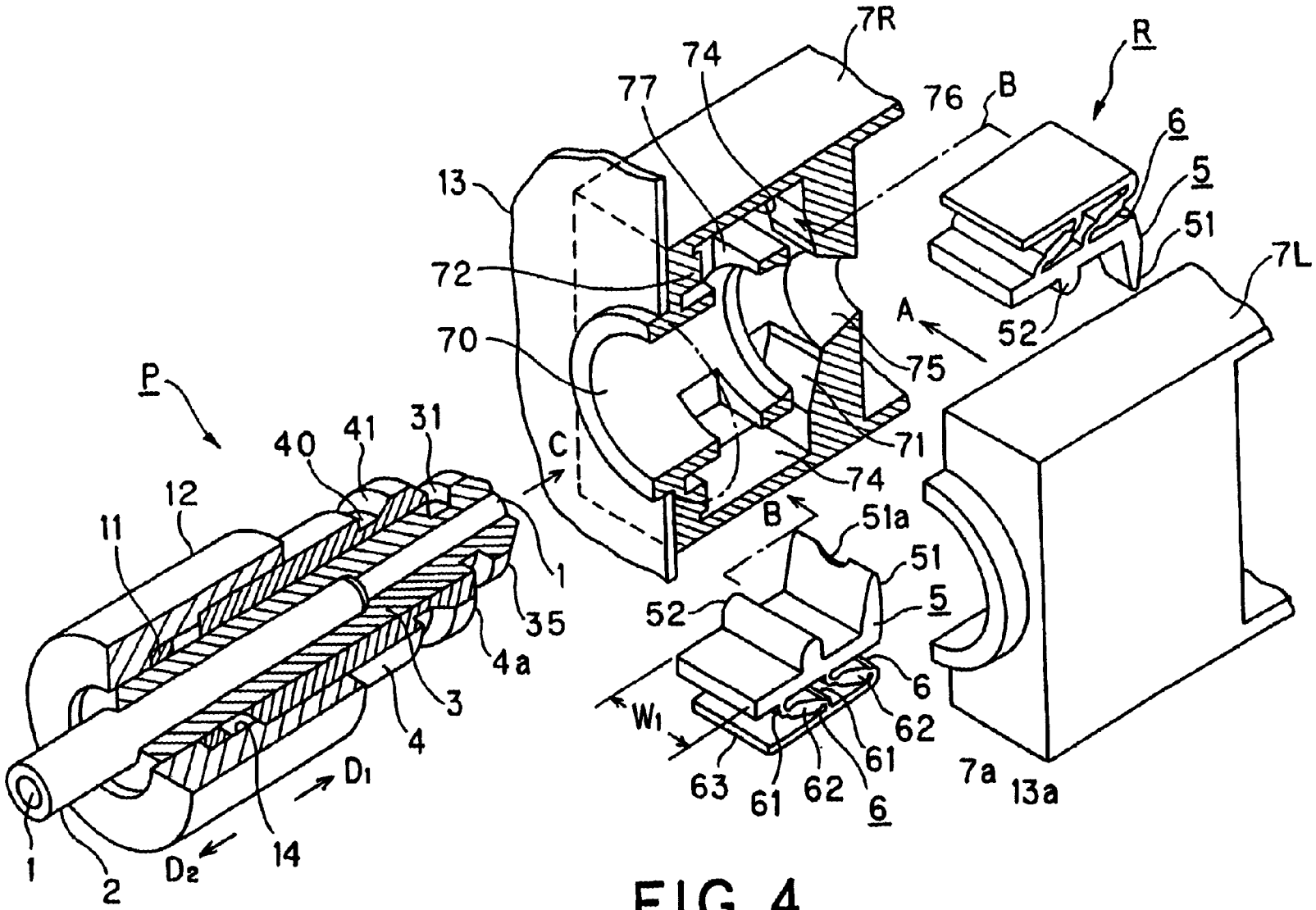
FIG. 4 is an exploded perspective view showing an example of a connection device according to the present invention.

A connection device according to the present invention is constituted by a plug unit P and a receptacle unit R as a receiving unit for the plug unit, as shown in FIG. 4.

The plug unit P is mounted at an end of an optical cable 2 which can transmit, for example, a light signal. The receptacle unit R is mounted on a panel 13 on the back side or the like of an electronic equipment.

In such a connection device, the plug unit P is inserted in the direction of an arrow C in FIG. 4 into a plug insertion hole 70 provided at the center on the front side of the receptacle unit R, thereby connecting an optical fiber 1, which is a cable core of the optical cable 2 exposed at the distal end of the plug unit P, with an optical element 1*a* arranged in the equipment. Instead of the optical element 1*a*, an optical fiber may be arranged in the equipment so that signals may be transmitted and received between this optical fiber and the optical fiber 1 of the plug unit P.

The plug unit P constituting the connection device according to the present invention is constituted as follows. This plug unit P holds the optical fiber 1 and the optical cable 2 at the center of and concentrically with a substantially cylindrical connector plug 3, and has a ring-shaped plug movement range regulating member 11 mounted on the proximal end side, which is situated on the left side in FIGS. 4 and 5. The optical cable 2 and the plug movement range regulating member 11 are integrally fixed on the connector plug 3 by a nail-like cable pin 10.

On the outer circumference of the connector plug 3, an unlocking member 4 is movably mounted which unlocks a lock mechanism for locking the plug unit P to the receptacle unit R when the plug unit P is inserted in the receptacle unit R. The unlocking member 4 is cylindrically formed. A tapered portion 4*a* tapered toward its distal end is formed at a distal end portion of the unlocking member 4, which is on the right side in FIGS. 4 and 5, and a ring-shaped cam groove 40 is formed at a halfway portion on the distal end side. A rising surface of this cam groove 40 on the distal end side of the unlocking member 4 is an inclined surface portion 41. A through-hole formed at the center of the unlocking member 4 has such a diameter that the connector plug 3 inserted in this through-hole is freely movable.

At a proximal end portion of the unlocking member 4, a knob portion 12 is mounted which is used for holding the plug unit P when operating the unlocking member 4 to insert the plug unit P into the receptacle unit R. The knob portion 12 is cylindrically formed. By meshing a screw portion 12*a* formed on the inner circumferential surface on the distal end side with a screw portion formed on the outer circumferential surface on the proximal end side of the unlocking member 4, the knob portion 12 is integrally mounted on the unlocking member 4.

On the inner circumference on the proximal end side of the knob portion 12, a housing recess 14 for housing the plug movement range regulating member 11 is formed. The housing recess 14 is formed with a length large enough to allow a predetermined range of movement of the unlocking member 4, which is mounted movably with respect to the connector plug 3. That is, the unlocking member 4 is movable in the direction of an arrow D1 or D2 in FIG. 5 within the range of the housing recess 14, together with the knob portion 12 integrally mounted on the unlocking member 4.

In the following description, the direction of the arrow C in FIG. 4 may be referred to as "axial direction of the cable" and the direction perpendicular to the direction of the arrow C may be referred to as "perpendicular direction to the axis of the cable".

In order to prevent skidding when holding the plug unit P and inserting the plug unit P into the receptacle unit R, a number of recesses and protrusions may be formed on the outer circumferential surface of the knob portion 12.

The receptacle unit R constituting the connection device according to the present invention will now be described.

The receptacle unit R has a receptacle 7 constituted by abutting and connecting, in the direction of an arrow A in FIG. 4, a pair of receptacle halves 7R, 7L which are integrally molded by using plastics and are horizontally symmetrical.

The receptacle 7 may be bisected by the direction of insertion of the plug unit P inserted into the receptacle 7. A dividing method which uses a perpendicular surface passing through the axial core of the cable of the plug unit P may be suitably selected in accordance with the internal structure of the receptacle 7.

At the center of the receptacle 7 constituting the receptacle unit R, the plug insertion hole 70 for inserting the plug unit P therein is formed in the state where the left and right receptacle halves 7R, 7L are joined together. At a distal end part of the plug insertion hole 70 on the insertion side of the plug unit P, a receiving-side tapered portion 75 is formed which is the countertype of the tapered portion 35 formed at and tapered toward the distal end of the connector plug 3 of the plug unit P, and in which this tapered portion 35 is fitted. By thus providing the tapered portions 35, 75 to fit with each other on the connector plug 3 and the plug insertion hole 70 of the receptacle 7, respectively, the center of the connector plug 3 can be accurately aligned with the center of the plug insertion hole 70, thus connecting the plug unit P with the receptacle unit R.

In the receptacle 7, a space constituting a lock member housing portion 74 is formed at vertically opposite positions based on the plug insertion hole 70 as the center. The lock member housing portion 74 communicates with the plug insertion hole 70 via first and second through-holes 76, 77.

Figure 6:
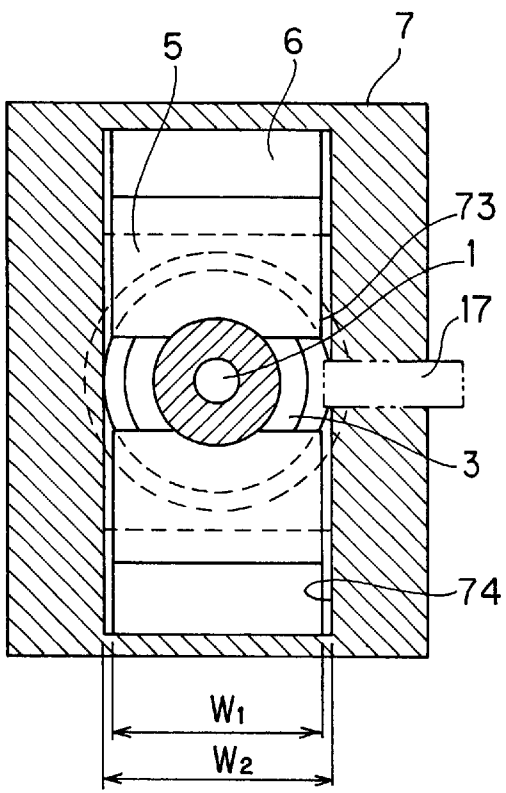
FIG. 6 is a cross-sectional view along a line VI—VI of FIG. 5.
Figure 5:
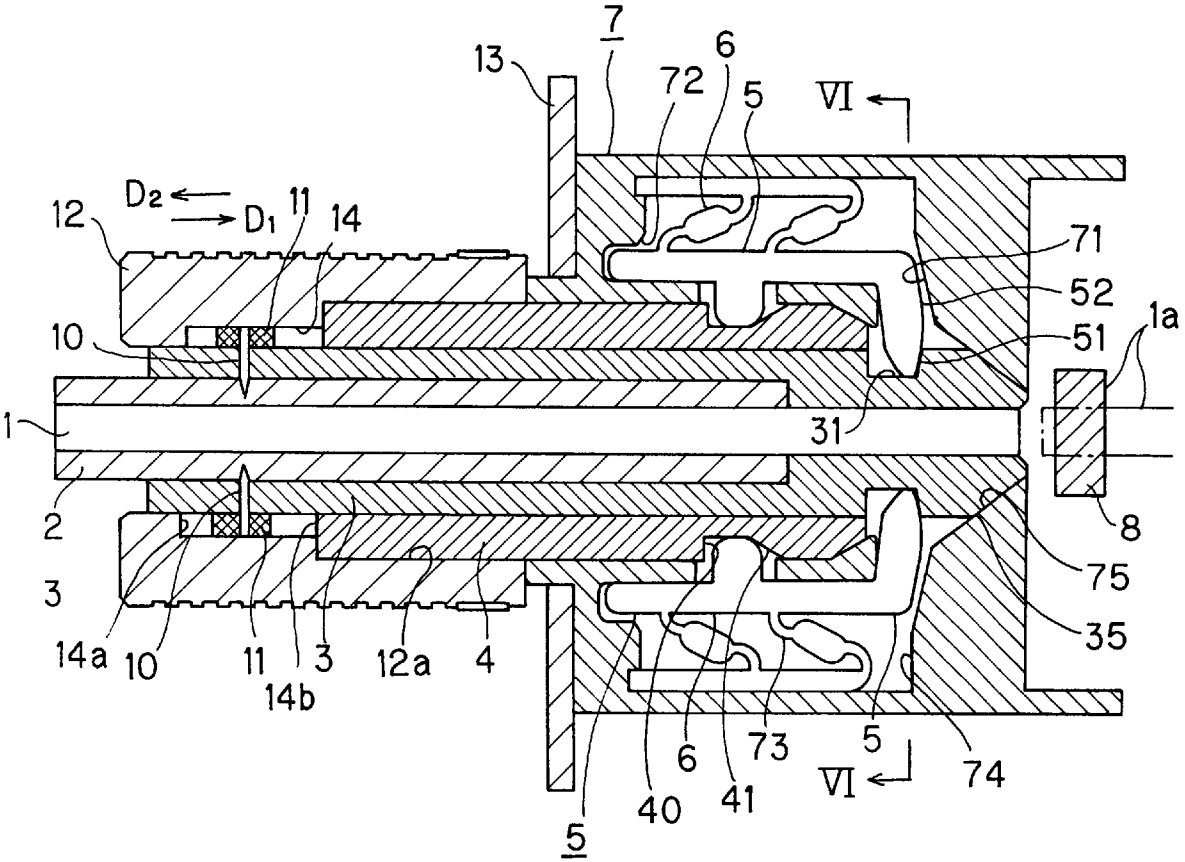
FIG. 5 is a cross-sectional view showing the inserting state of a plug unit to a receptacle unit in the connection device according to the present invention.

In each of a pair of lock member housing portions 74, 74 provided in the receptacle 7, a lock member 5 with a Z spring 6 is housed and arranged, as shown in FIGS. 5 and 6. The lock member 5 housed in the lock member housing portion 74 has a plug engagement pawl 51 provided on its distal end side and protruding into the plug insertion hole 70 via the first through-hole 76, and has a press operator 52 provided at its halfway portion and protruding into the plug insertion hole 70 via the second through-hole 77. With respect to each of the lock members 5, 5 thus housed and arranged in the lock member housing portions 74, when the plug unit P is inserted into the plug insertion hole 70, the plug engagement pawl 51 provided at the distal end protrudes into the plug insertion hole 70 from the first through-hole 56 and is engaged with an engagement pawl engagement groove 31 formed on the outer circumferential surface on the distal end side of the connector plug 3, and the press operator 52 protrudes into the plug insertion hole 70 from the second through-hole 77 and is engaged with the cam groove 40 provided on the unlocking member 4, as shown in FIG. 5.

In the panel 13 on the electronic equipment side where the receptacle 7 is arranged, a circular extraction hole 13*a* is provided, as indicated by a dotted chain line in FIG. 4. This extraction hole 13*a* is fitted with a ring-shaped fitting protrusion 7*a* provided at the center on the front side of the receptacle 7. In the exploded perspective view shown in FIG. 4, only the panel 13 at the front part of the receptacle half 7R is shown. Although not shown, the receptacle 7 is fixed at a predetermined position on the panel 13, for example, by inserting an attachment screw into an attachment hole provided in the panel 13 and then screwing the attachment screw into a screw hole provided on the front surface of the receptacle 7.

The lock member 5 used for holding the plug unit P inserted in the receptacle unit R at the inserting position is, for example, integrally molded with the Z spring 6 by using plastics or the like. The lock member 5 is accommodated from the direction of an arrow B in FIG. 4 to the lock member housing portion 74, which is a substantially rectangular space provided at vertically two positions in the receptacle 7. In this case, the Z spring 6 is compressed by an external force and generates forces in two directions to the lock member 5, that is, the axial direction of the cable and the direction perpendicular to the axial direction of the cable, as will be described later.

The lock member 5 provided on the receptacle unit R for locking the plug unit P at a predetermined inserting position will be described further in detail with reference to FIGS. 7 and 8.

Figure 7:
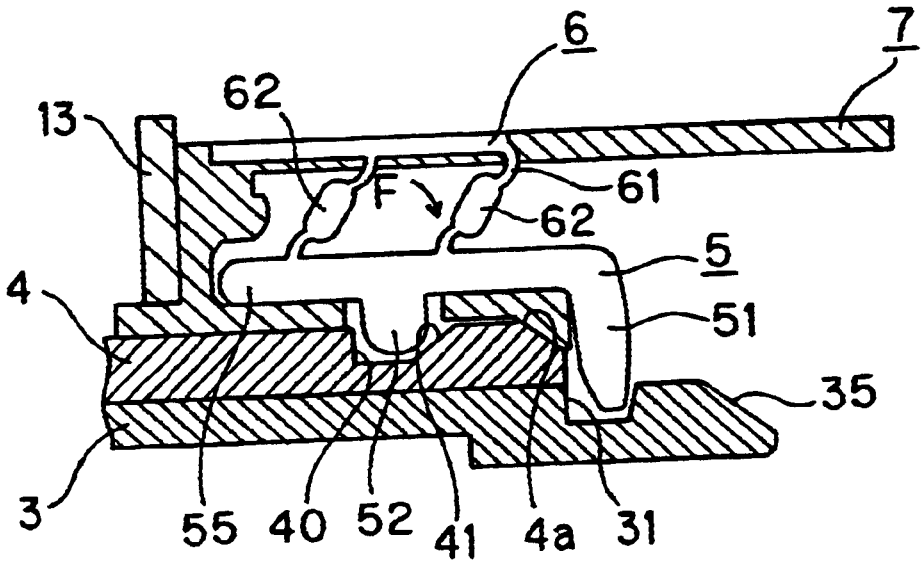
FIG. 7 is a side view showing a lock member molded integrally with a Z spring constituting the connection device according to the present invention.
Figure 8:
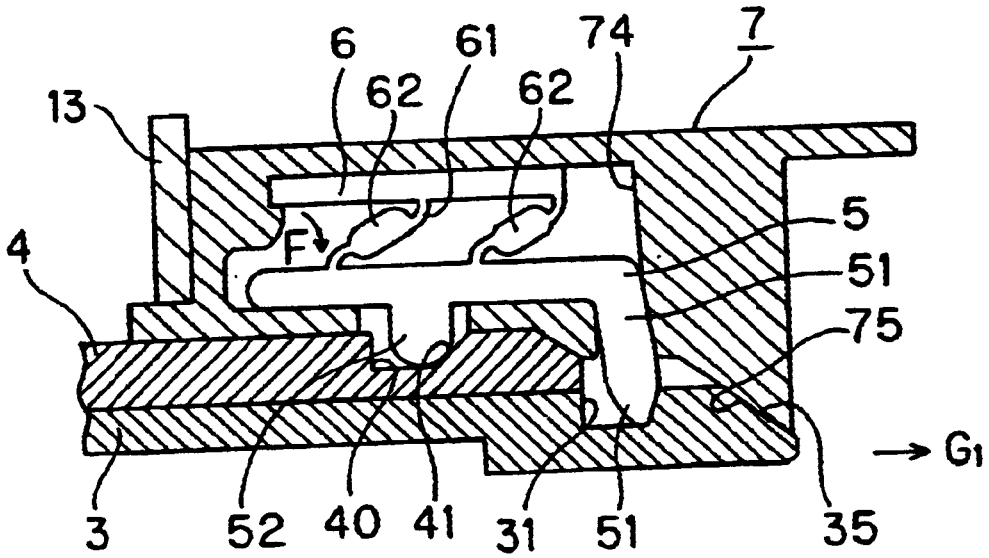
FIG. 8 is a side view showing the state in which the lock member is housed in a receptacle housing portion.

When the Z spring 6 is in a released state with no external force applied thereto and the lock member 5 is housed in the lock member housing portion 74, the lock member 5 is in a state as shown in FIGS. 7 and 8.

The lock member 5 is formed in the shape of a rectangular flat plate with a width indicated by W1 in FIG. 4. The plug engagement pawl 51 is formed by bending the lock member 5 almost perpendicularly at its one end, and the protruding press operator 52 having a length equivalent to the width W1 is formed substantially at the center of the lock member 5. Thus, the lock member 5 is formed substantially in an F-shape as viewed from the lateral side.

The plug engagement pawl 51 has an arcuately recessed recess portion 51*a* at the center of its distal end, as shown in FIGS. 4 and 5, in order to secure the engagement with the engagement pawl engagement groove 31 formed as a ring-shaped groove portion on the outer circumferential surface on the distal end of the connector plug 3. However, the distal end of the plug engagement pawl 51 may be straight without providing the arc. Similarly, the distal end of the press operator 52 may be arcuately recessed at its distal end, instead of being straight as shown in the drawings.

With respect to the lever such as the lock member 5 which is formed as a lever having a predetermined length and has the plug engagement pawl vertically rising at one end of the lever body and the protruding press operator at the halfway part of the lever body, it is normal that the other end, which is opposite to the one end having the plug engagement pawl provided thereon, is fixed so that the lock member 5 is supported to be rotatable about the fixed position as the pivotal point. However, in the case where the lock member 5 is housed in the lock member housing portion 74 as in the present invention, a member for regulating the pivotal point of the lock member 5 to one point is not provided in the lock member housing portion 74. Therefore, the other end, which is opposite to the one end having the plug engagement pawl 51 provided thereon, of the lock member 5 housed in the lock member housing portion 74, can move as a movable pivotal point in the up-and-down direction and the left-and-right direction in the lock member housing portion 74. In order to regulating such movement of the lock member 5, a movable range regulating portion 72 for regulating the movement of the other end as the pivotal point of the lock member 5 and a rotation guide portion 71 for guiding the direction of rotation of the plug engagement pawl 51 when rotated about the pivotal point at the other end are provided in the lock member housing portion 74, as shown in FIG. 5. The movable range regulating portion 72 and the rotation guide portion 71 are formed as parts of the inner circumferential surface of the lock member housing portion 74.

The lock member housing portion 74 formed in the receptacle 7 has a width W2 greater than the width W1 of the lock member 5, as shown in FIG. 6, and therefore the contact in the direction of the width prevents rotation of the lock member 5 and movement of the Z spring 6.

As will be later described in detail, the press operator 52 provided on the lock member 5 functions as a cam follower of the cam mechanism constituted by the tapered portion 4*a* provided on the distal end side of the unlocking member 4 and the inclined surface portion 41 in the cam groove 40, and thus rotationally operates the lock member 5. When the plug engagement pawl 51 provided on the lock member 5 is engaged with the engagement pawl engagement groove 31 provided on the connector plug 3, the plug engagement pawl 51 presses the connector plug 3 toward the receptacle 7.

The shape and function of the Z spring 6 provided integrally with the lock member 5 will now be described with reference to FIGS. 4, 7 and 8.

The Z spring 6 formed integrally with the lock member 5 is constituted by forming relatively thin semicircular spring portions 61 formed at both ends of a short pole brace 62. The other ends of the semicircular spring portions 61 are connected and integrated with a rectangular thin plate 63 held by the receptacle 7 and with the lock member 5, respectively.

The width W1 of the lock member 5 and the widths of the thin plate 63, the spring portions 61 and the pole brace 62 are made the same.

The pole brace 62 is not necessarily required. A single spring portion 61 may have its both ends connected to the thin plate 63 and the lock member 5, respectively.

A set of spring portions 61, 61 of the Z spring 6 are connected to one end of the thin plate 63 and a portion near the center of the lock member 5, respectively. Another set of spring portions 61, 61 are connected to the center of the thin plate 63 and a portion near the pivotal point portion 55 of the lock member 5, respectively. The two Z springs 6, 6 are made parallel to each other, and the thin plate 63 and the lock member 5 are maintained parallel to each other. The two Z springs 6, 6, the thin plate 63 and the lock member 5 substantially form a parallelogram.

When the lock member 5 and the Z springs 6 are accommodated into the lock member housing portion 74 of the receptacle 7 from the direction of an arrow B as shown in FIG. 4, the Z springs 6 are compressed so that the parallelogram formed by the Z springs 6 and the lock member 5 becomes vertically flat, as shown in FIG. 8. In this state, the Z springs 6 are pressed so as to be turned in the direction of an arrow F in FIGS. 7 and 8 with respect to the thin plate 63 and the lock member 5, and thus apply to the lock member 5 a force in the direction perpendicular to the axial core of the cable and a force in the direction parallel to the axial core of the cable.

That is, the Z springs 6, 6 act as a type of torsion spring energized by a change of the rotation angle of the springs.

In the connection device according to the present invention, when the plug unit P is inserted in the receptacle unit R, the tapered portion 35 formed at the distal end of the connector plug 3 is relatively fit with the tapered portion 75 provided on the side of the plug insertion hole 70 of the receptacle 7, as shown in FIGS. 5 and 8. Thus, the plug unit P can be connected to the receptacle unit R, with the center of the connector plug 3 accurately aligned with the center of the plug insertion hole 70.

In this case, the plug engagement pawl 51 of the lock member 5 is engaged with the engagement pawl engagement groove 31 of the connector plug 3 and presses the connector plug 3 rightward in the direction of an arrow G1 in FIG. 8. The press operator 52 is engaged with the cam groove 40 of the unlocking member 4.

The process of inserting the plug unit P into the receptacle unit R will be described in detail with reference to FIGS. 9A to 9F.

FIGS. 9A to 9F show the upper half of the receptacle 7 and the upper halves of the connector plug 3 and the unlocking member 4 of the plug unit P, as cross-sectional views similar to FIG. 5, and schematically show the state of the clock member 5 in accordance with steps corresponding to the inserting position of the plug unit P.

Figure 9A:
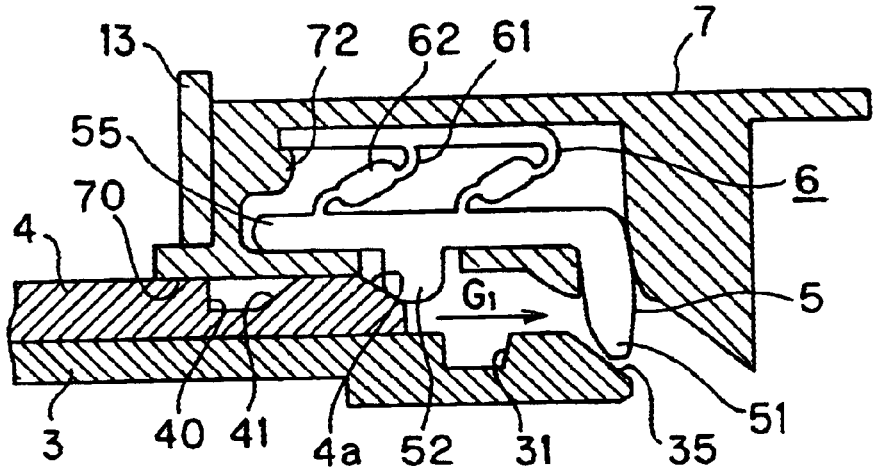
FIGS. 9A to 9F are side views showing the process of inserting the plug unit into the receptacle unit and the operation of the lock member molded integrally with the Z spring.

To insert the plug unit P into the receptacle unit R, the knob portion 12 is held by fingers and the connector plug 3 is inserted together with the unlocking member 4 into the plug insertion hole 70, as shown in FIG. 9A. Before inserting the plug unit P into the plug insertion hole 70 of the receptacle unit R, the lock member 5 is pushed by the Z springs 6 and has its entire surface abutted against the lower side of the lock member housing portion 74.

As the plug unit P is inserted in the receptacle unit R, the tapered portion 4*a* formed on the insertion end side of the unlocking member 4 is abutted against the press operator 52, as shown in FIG. 9A.

Figure 9B:
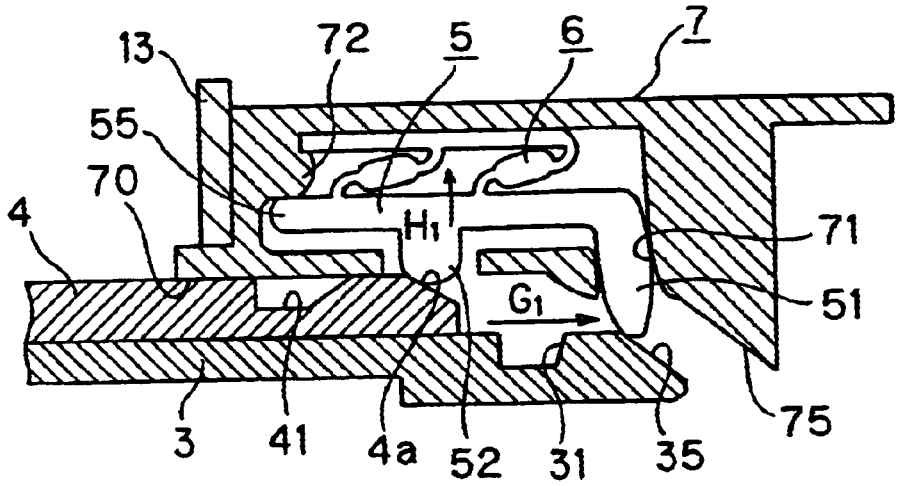

When the plug unit P is further inserted in the direction of an arrow G1 in FIG. 9A, the tapered portion 4*a* at the distal end of the unlocking member 4 pushes the press operator 52 upward in the direction of an arrow H1 as shown in FIG. 9B.

The other end portion of the lock member 5, which is opposite to the side where the plug engagement pawl 51 is provided, is abutted against the lower end of the movable range regulating portion 72 and the lock member 5 is rotated about this position as the pivotal point, thus taking a substantially horizontal posture, as shown in FIG. 9B.

The connector plug 3 can enter the plug insertion hole 70 until the plug engagement pawl 51 is situated on the upper part of the tapered portion 35 on the distal end side.

Figure 9C:
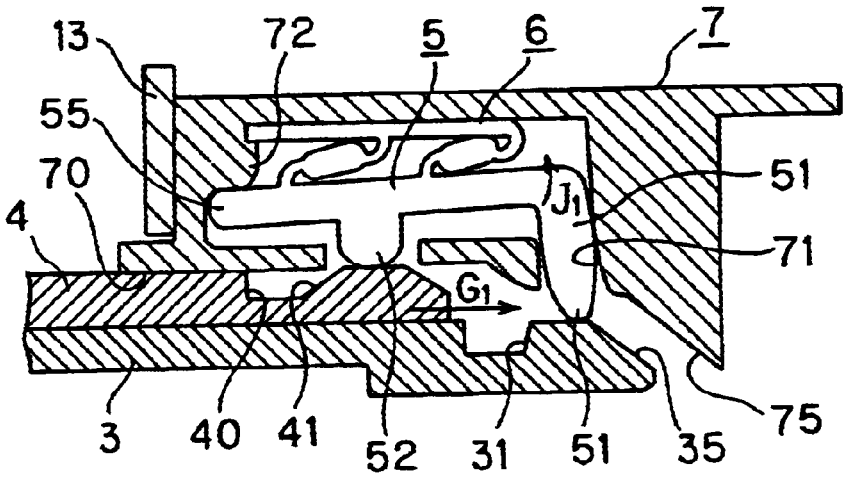

As the plug unit P is further inserted into the receptacle unit R and reaches the state shown in FIG. 9C, the press operator 52 goes aground on the highest part of the outer circumferential surface of the unlocking member 4, that is, the portion having the largest diameter. The lock member 5 is turned in the direction of an arrow J1 in FIG. 9C about the pivotal point portion 55 abutted against the lower end of the movable range regulating portion 72 and has its insertion end side lifted up, and the plug engagement pawl 51 is detached from the engagement pawl engagement groove 31 of the connector plug 3.

Figure 9D:
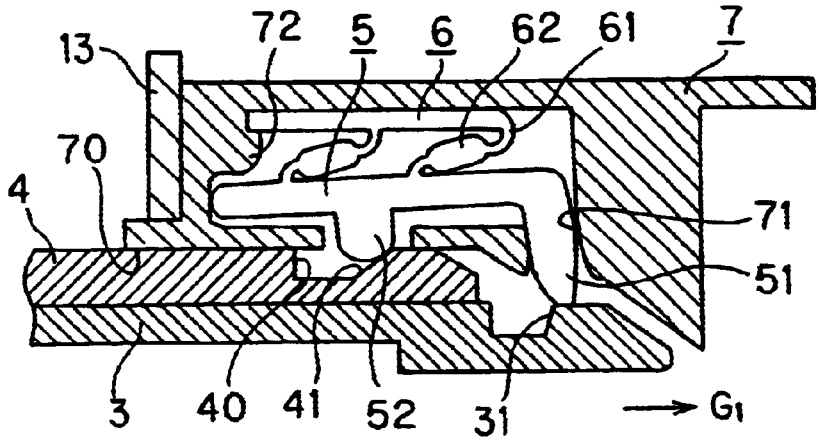

When the plug unit P is further inserted into the receptacle unit R, the press operator 52 goes around on the inclined surface portion 41 formed in the cam groove 40, and the plug engagement pawl 51 is abutted against the outer circumferential surface of the connector plug 3, thus supporting the lock member 5, as shown in FIG. 9D. The lock member 5 takes such a posture that the other end side on the left in FIG. 9 is lowered.

Figure 9E:
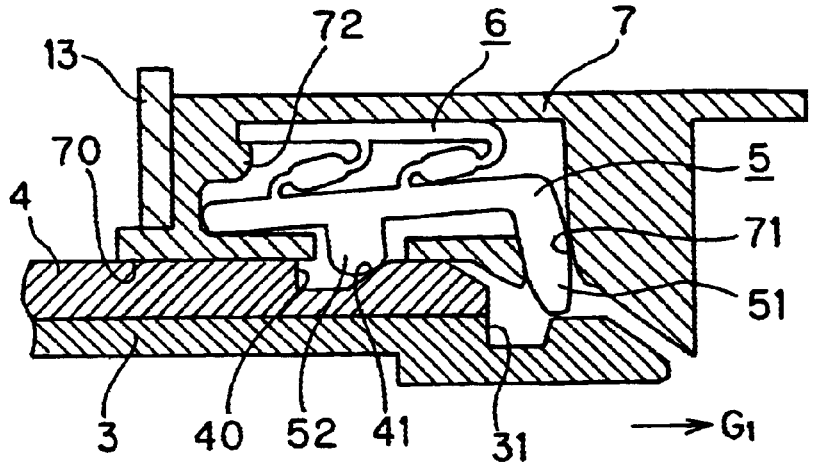

As the plug unit P is inserted to the state shown in FIG. 9E, the other end side of the lock member 5 is lowered and abutted against the lower side of the lock member housing portion 74. The press operator 52 is abutted against the inclined surface portion 41 of the cam groove 40, thus supporting the lock member 5. The lock member 5 is guided by the rotation guide portion 71 and moves as a whole in the direction of an arrow G1 in FIG. 9E, so that the plug engagement pawl 51 can easily fall into the engagement pawl engagement groove 31 of the plug connector 3.

Figure 9F:
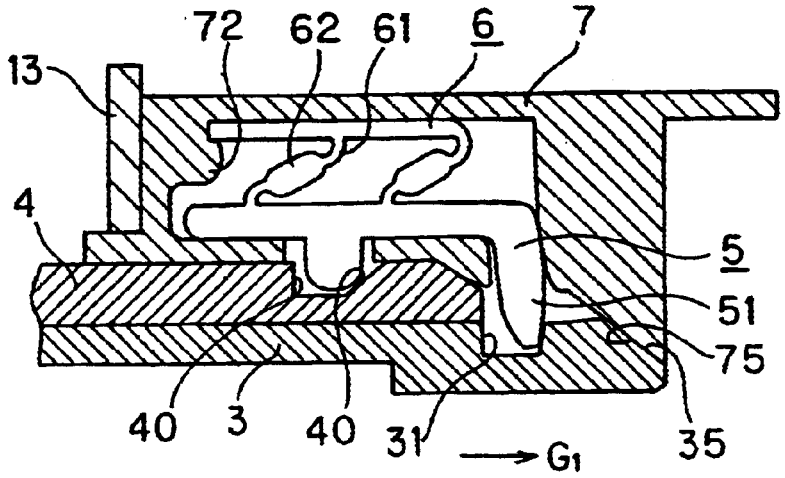

FIG. 9F shows the state where the plug unit P is completely inserted in the receptacle unit R. The plug engagement pawl 51 falls in the engagement pawl engagement groove 31 of the connector plug 3, and the tapered portion 35 at the distal end of the connector plug 3 is completely in contact with the tapered portion 75 provided in the plug insertion hole 70. An energizing force of the Z springs 6 in the axial direction, that is, an energizing force in the direction of an arrow G1 in FIG. 9F, moves the lock member 5 guided by the rotation guide portion 71 into the direction of the arrow G1 in FIG. 9F, and causes the plug engagement pawl 51 to push the connector plug 3 in the same direction, that is, rightward in FIG. 9F.

In this manner, even after the completion of insertion, the energizing force of the Z springs 6 causes the plug engagement pawl 51 to push the connector plug 3 rightward in the direction of the arrow G1 in FIG. 9F. Thus, the position of the connector plug 3 can be constantly held and the optical fiber can be maintained at a predetermined position.

Hereinafter, the operation steps for extracting the plug unit P inserted in the receptacle unit R will be described with reference to FIGS. 10A to 10E. FIGS. 10A to 10E show extraction steps 1 to 5, as viewed from the same direction as FIGS. 9A to 9F.

Figure 10A:
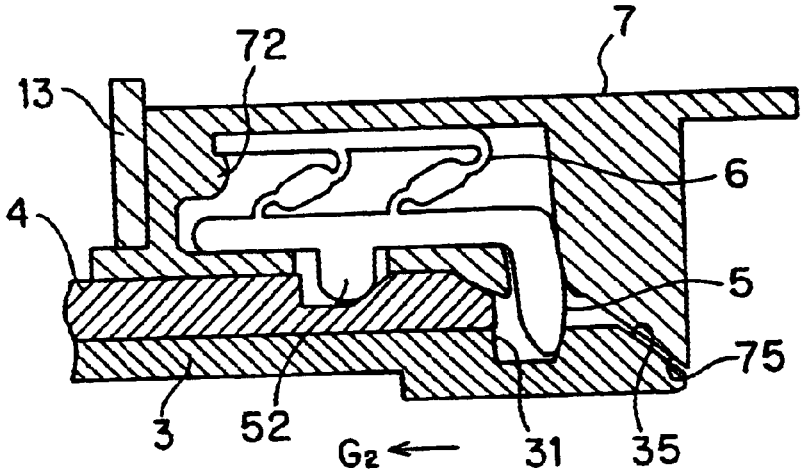
FIGS. 10A to 10E are side views showing the process of extracting the plug unit from the receptacle unit and the operation of the lock member formed integrally with the Z spring.

To extract the plug unit P from the receptacle unit R, the knob portion 12 is held and the unlocking member 4 is extracted leftward in the direction of an arrow G2 in FIG. 10A together with the knob portion 12, as shown in FIG. 10A. When the unlocking member 4 is extracted, the press operator 52 of the lock member 5 goes aground on the inclined surface portion 41 in the cam groove 40.

Figure 10B:
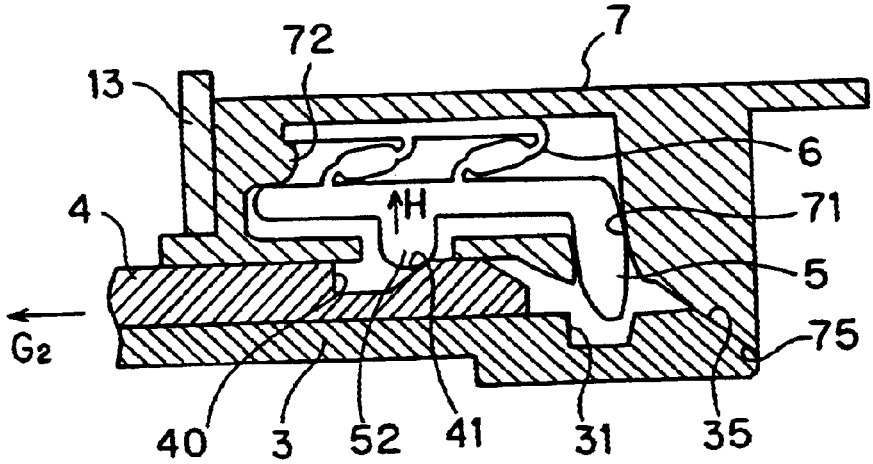

As the unlocking member 4 is further moved into the direction of an arrow G2 in FIG. 10B, the press operator 52 is pushed up by the inclined surface portion 41 of the cam groove 40 and the other end of the lock member 5 on the left side in FIG. 10B is abutted against the lower end of the movable range regulating portion 72. The lock member 5 is turned about this point as the pivotal point and takes a substantially horizontal posture. The Z springs 6 are slightly compressed.

In this case, the lock member 5 moves substantially vertically upward in the direction of an arrow H1 in FIG. 10B. The plug engagement pawl 51, too, moves substantially vertically and is detached from the engagement pawl engagement groove 31 of the connector plug 3.

Therefore, the rising surface of the engagement pawl engagement groove 31 of the connector plug 3 can be steep, with its angle being close to a right angle to the axial direction.

Figure 10C:
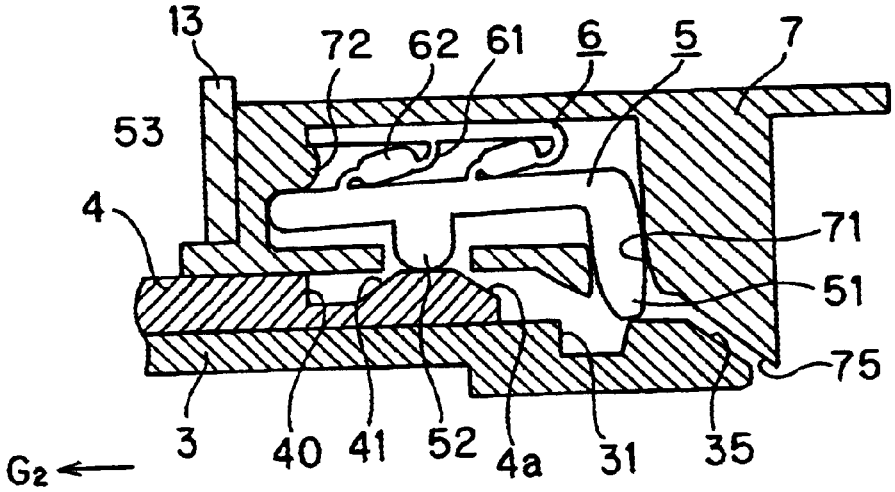

When the unlocking member 4 is further moved into the direction of the arrow G2 in FIG. 10B, the quantity of pushing up the press operator 52 reaches the maximum. As shown in FIG. 10C, while the left end on the other end side of the lock member 5 is still abutted against the lower end of the movable range regulating portion 72, the lock member 5 is rotated about this position as the pivotal point and takes such a posture that the right side is up with the plug engagement pawl 51 of the distal end detached from the connector plug 3. In this case, the Z springs 6 are compressed to the maximum extent, as shown in FIG. 10C. The plug engagement pawl 51 leaves the engagement pawl engagement groove 31 of the connector plug 3, and the connector plug 3 moves in the direction of an arrow G2 in FIG. 10C together with the unlocking member 4.

Figure 10D:
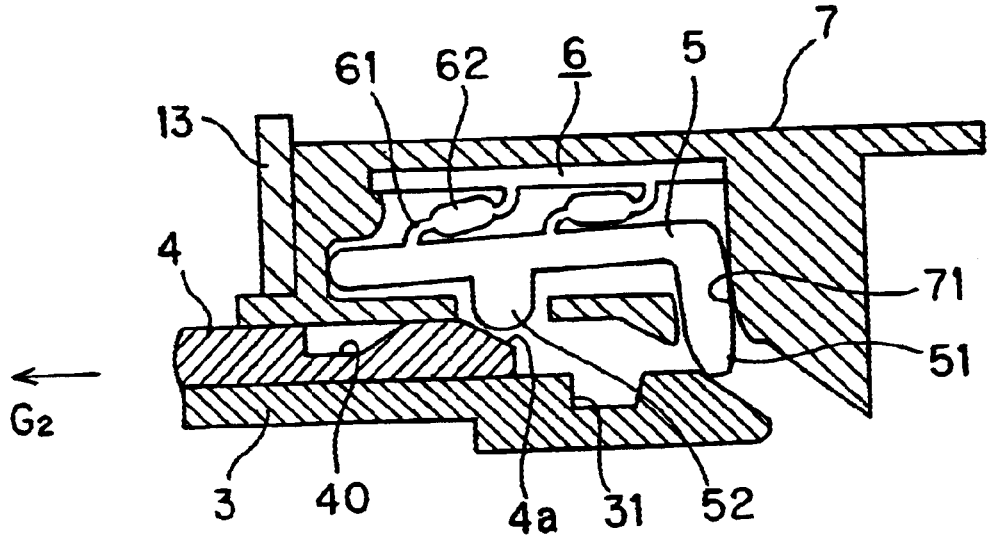

When the plug unit P is further pulled in the direction of the arrow G2 in FIG. 10C, that is, in the direction of extraction from the receptacle unit R, the press operator 52 is lowered toward the connector plug 3 and the other end of the lock member 5 is lowered, too, and is detached from the lower end of the movable range regulating portion 72, as shown in FIG. 10D. At this step of FIG. 10D, the connector plug 3 is made freely movable in the direction of an arrow G2 in FIG. 10D without having a large load applied thereto along with the unlocking member 4.

Figure 10E:
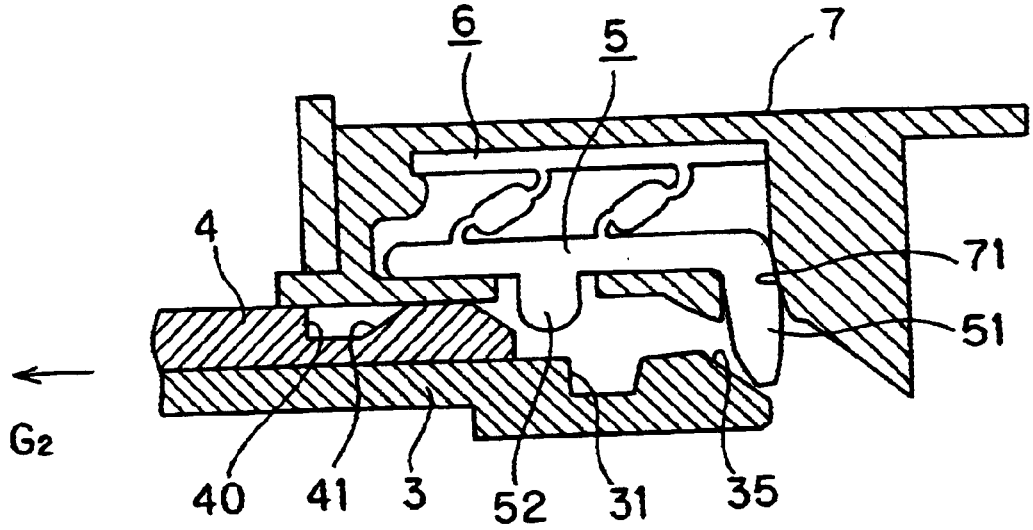

As the plug unit P is further extracted in the direction of an arrow G2 in FIG. 10E, the unlocking member 4 and the connector plug 3 are made freely movable without being constrained by the lock member 5.

The lock member 5 is pushed by the Z springs 6 and has it entire surface abutted against the lower side of the lock member housing portion 74, thus restoring the initial state shown in FIG. 9A, which has already been described.

At the above-described steps of insertion and extraction of the plug unit P to and from the receptacle unit R, the lock member 5 is driven by the movement of the unlocking member 4 in the axial direction of the cable and is guided by the movable range regulating portion 72 and the rotation guide portion 71, thus changing its posture step by step. In this case, the pivotal point portion 55 on the other end side of the lock member 5, which is opposite to the side where the plug engagement pawl 51 is provided, is moved in its position vertically and horizontally. That is, the operation of the lock member 5 is characterized in that the pivotal point is not limited to one point and can freely move in a certain range.

Other examples of the Z spring 6 constituting the connection device according to the present invention will now be described with reference to FIGS. 11A to 14. FIGS. 11A, 11B and 12A, 12B show three types of Z springs in the same drawing manner as in FIGS. 9A to 10E, and show the free forms of the springs with no external force applied thereto and the compressed forms when housed in the receptacle.

Figure 11A:
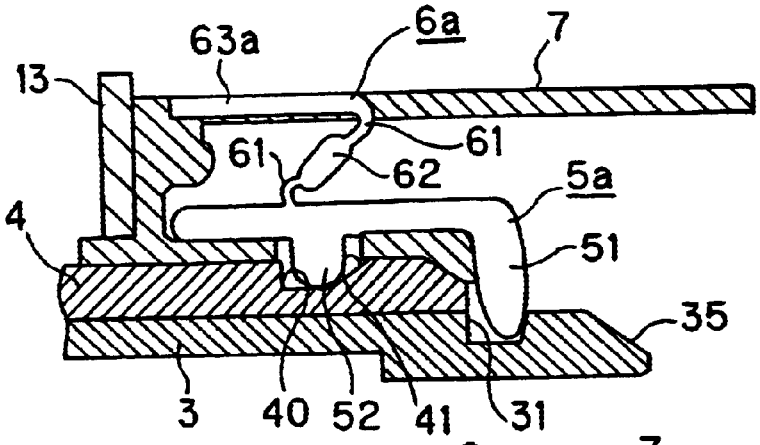
FIGS. 11A and 11B show another example of the lock member using a Z spring, which is used in the connection device according to the present invention.
Figure 11B:
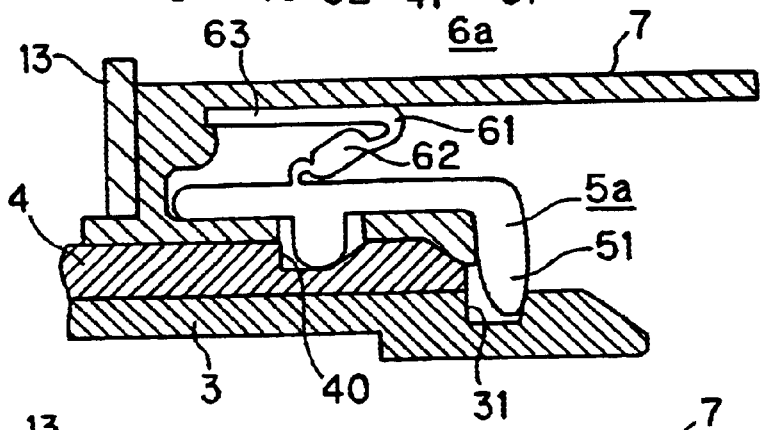

A Z spring 6*a* shown in FIGS. 11A and 11B is a single Z spring 6*a* which has a substantially thin semicircular spring portion 61 formed at both ends of a short pole brace 62, as in the above-described case where two Z springs are used. The other ends of the semicircular spring portions 61 are connected and integrated with a thin plate 63*a* and a lock member 5*a,* respectively. The Z spring 6*a* functions as a torsion spring and applies to the lock member 5*a* force perpendicular to the axial core of the cable and a force horizontal to the axial core of the cable.

Only one Z spring 6*a* may suffice in this manner, or three or more such Z springs 6*a* can be used. By changing the strength of the spring portions and the pivotal point position, the ratio of the horizontal and vertical forces applied to the lock member 5*a,* indicated by arrows in FIG. 11B, can be arbitrarily selected.

Figure 12A:
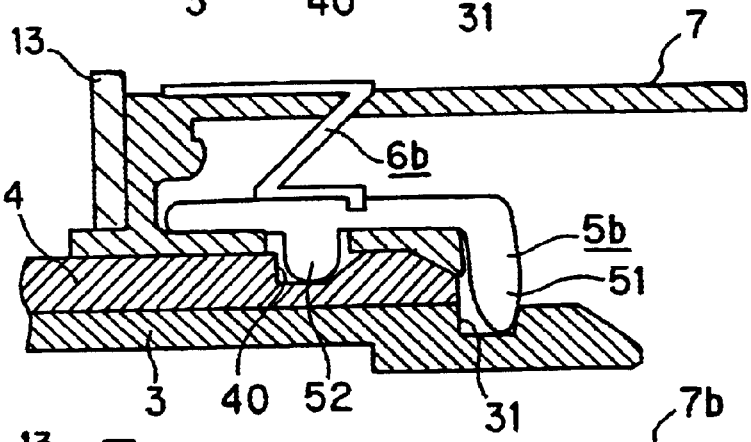
FIGS. 12A and 12B show still another example of the lock member using a Z spring, which is used in the connection device according to the present invention.
Figure 12B:
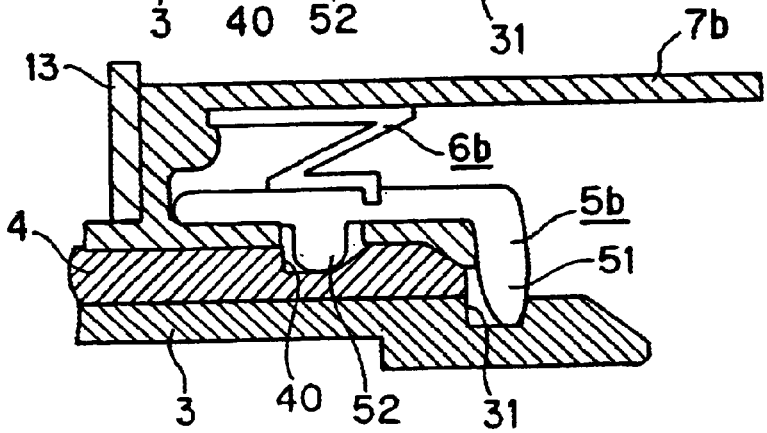

FIGS. 12A and 12B show a Z spring formed by using a thin plate of metal or the like, as a separate part from a molded lock member 5*b.* An inclined part at the center mainly functions as a torsion spring. Since the spring can be formed by bending a simple rectangular member, and one end at a lower part can be bent and connected to the lock member 5*b,* the Z spring can be processed at a low cost.

Figure 13A:
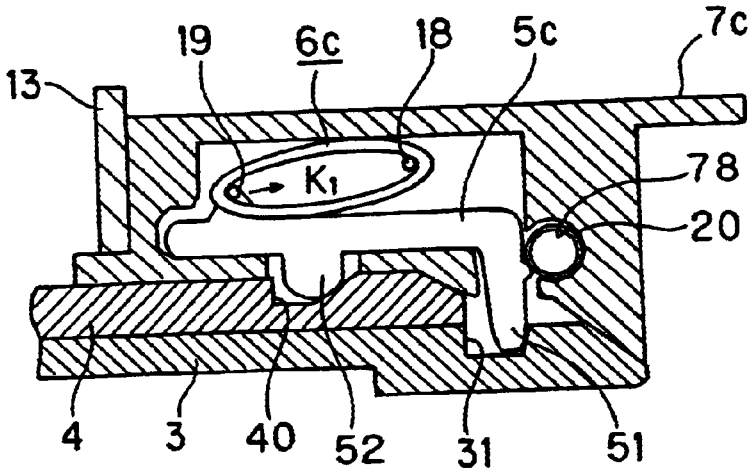
FIGS. 13A and 13B show an example of a lock member using a ring-shaped spring, which is used in the connection device according to the present invention.
Figure 13B:
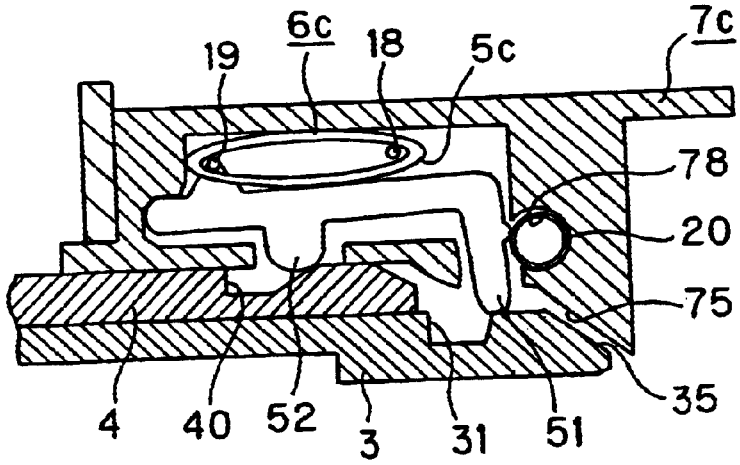

It is also possible to use an O-ring-shaped spring 6*c* shown in FIGS. 13A and 13B, instead of the Z spring. A thin cylindrical member is compressed in the radial direction to form a substantially elliptical spring. The thickness in the direction of the long diameter of the ellipse may be changed and the spring may be deformed before use.

Figure 14:
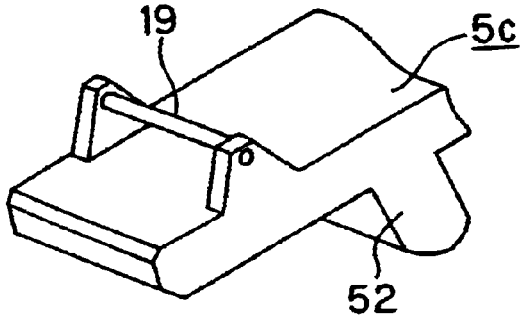
FIG. 14 is a partial perspective view showing another example of a lock member.

As an example, a lock member 5*c* shown in FIG. 14 is used which has a movable pin 19 provided in parallel to the direction of the width of the lock member 5*c*. A fixed pin 18 parallel to the movable pin 19 is provided at a predetermined position in a lock member housing portion 74 of a receptacle 7*c*, and when the O-ring-shaped spring 6*c* is mounted, the fixed pin 18 and the movable pin 19 are arranged in a hollow part inside the spring 6*c*.

In the receptacle 7*c* shown in FIGS. 13A and 13B, a lock member guide ball 20 is provided in a guide ball housing portion 78. The operation thereof will be described later.

When the O-ring-shaped spring 6*c* is mounted, a force substantially perpendicular to the axis of the cable due to spring compression is applied to the lock member 5*c*.

When the lock member 5*c* is at the lowest position that is closest to the connector plug 3, as shown in FIG. 13A, the compression quantity of the ring-shaped spring 6*c* is the minimum quantity and the long diameter of the ellipse is at its minimum, too. A force in the direction of an arrow K1 in FIG. 13A toward the center of the ellipse is applied to the movable pin 19, and the horizontal component of force of the movable pin 19 in the axial direction of the cable is applied to the lock member 5*c* as a rightward force in FIG. 13A.

When, at the step of inserting or extracting the plug unit P, the lock member 5*c* is at the highest position that is farthest from the connector plug 3, as shown in FIG. 13B, the ring-shaped spring 6*c* is extremely compressed and the long diameter of the ellipse is at its maximum. If the long diameter of the ellipse is longer than the distance between the outer parts of the fixed pin 18 and the movable pin 19, the force acting from the ring-shaped spring 6*c* to the movable pin 19 vanishes.

In this manner, it is convenient that the horizontal component of force decreases or vanishes during the insertion or extraction of the plug unit P, and that a strong horizontal component of force can be obtained particularly on completion of the insertion of the plug unit P when tight contact of the tapered portions 35, 75 of the connector plug 3 and the receptacle 7*c* is required.

As described above, the lock member constituting the connection device according to the present invention repeats vertical and horizontal fluctuations at every insertion or extraction step of the plug unit P, and its operation is repeated in a predetermined order. Thus, it can be said that the lock member has a hysteresis characteristic. As is already described, the fluctuations are made mainly in accordance with the guidance by the movable range regulating portion 72 and the rotation guide portion 71 provided integrally on the receptacle.

Figure 16:
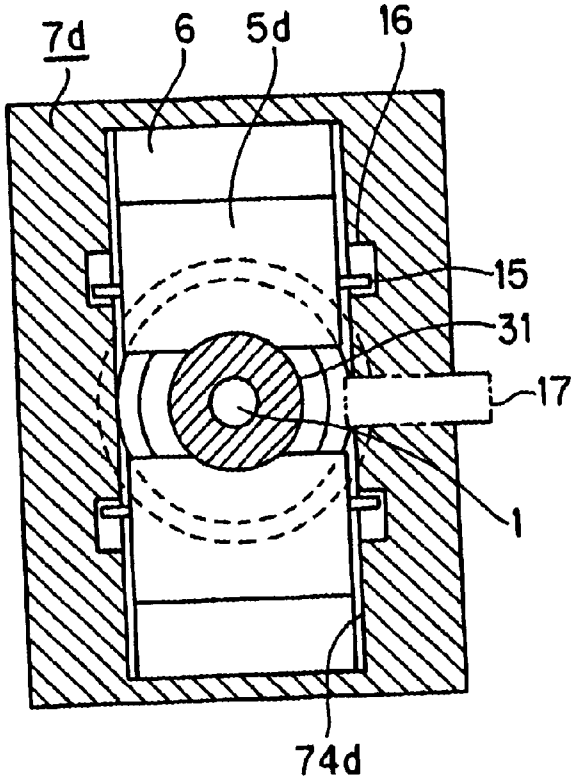
FIG. 16 is a cross-sectional view along a XVI—XVI line of FIG. 15.
Figure 15:
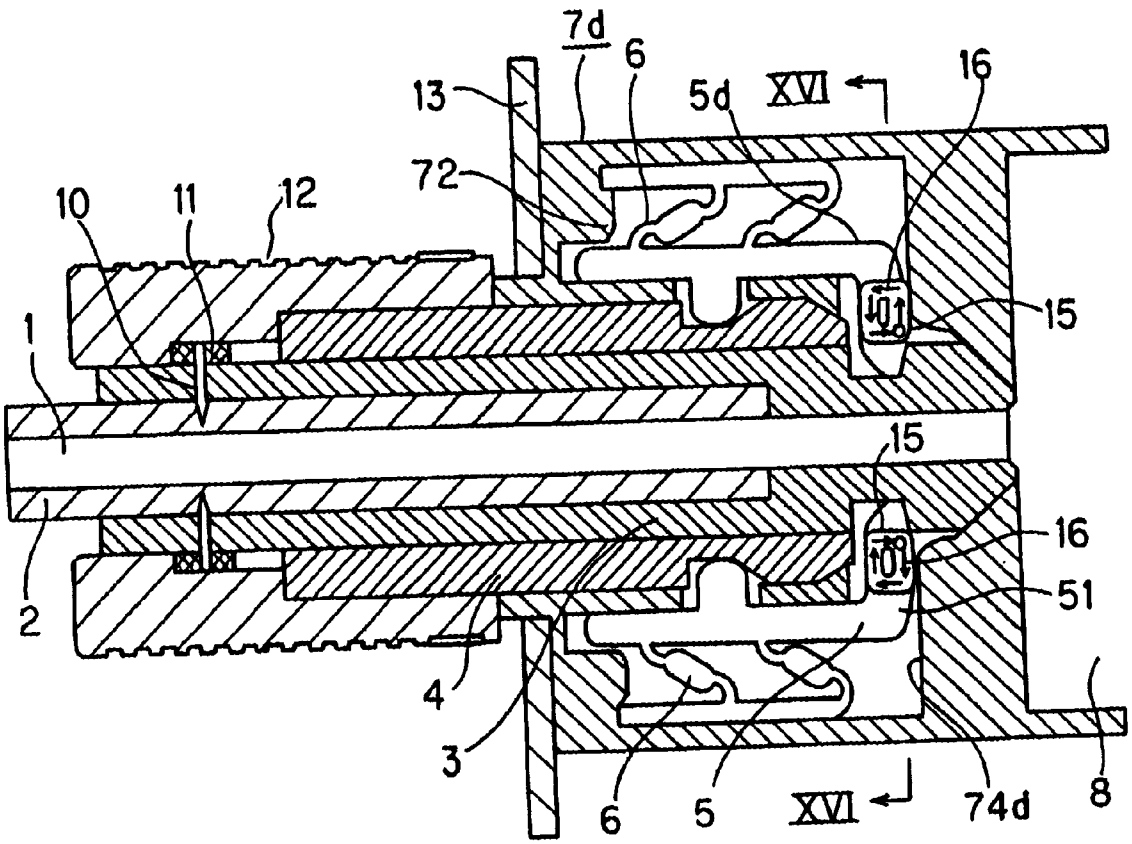
FIG. 15 is a cross-sectional view showing the connection device having a lock member with a lock member guide pin which designates the operating course of the lock member.

The similar hysteresis characteristic can be achieved, for example, by a mechanism shown in FIGS. 15 and 16.

A lock member 5*d* used in this case has lock member guide pins 15 integrally formed on both lateral sides near the distal end where a plug engagement pawl 51 is provided and also near the root of the plug engagement pawl 51.

At a total of four positions on both sidewalls of upper and lower lock member housing portions 74 of a receptacle 7*d*, recessed lock member guide groove 16 having a substantially O-shaped closed route are carved, and the lock member guide pins 15 are engaged with and guided by the lock member guide grooves 16.

When inserting or extracting the plug unit P, the lock member guide pin 15 goes around the lock member guide groove 16, thus enabling the lock member 5 to make predetermined fluctuations. The right side portion of the lock member housing portion 74*d* in FIG. 15 is enlarged so as not to prevent movement of the lock member.

The above-described hysteresis characteristic can also be achieved by using a lock member guide ball 20, which is a rotator taking the operation steps shown in FIGS. 17A to 17C and FIGS. 18A to 18C.

Figure 17A:
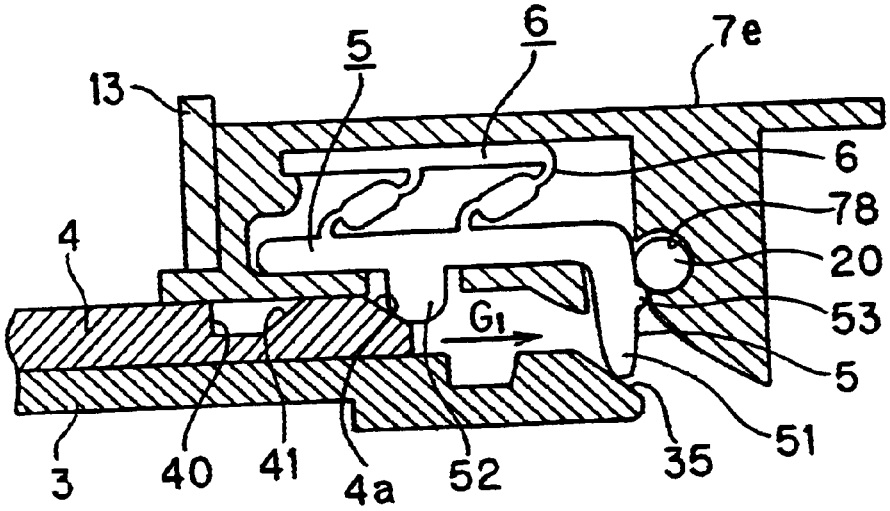
FIGS. 17A to 17C are side views showing the operation steps in inserting the plug unit, of a lock member using a guide ball which emphasizes a clicking touch when inserting the plug unit into the receptacle unit.
Figure 17B:
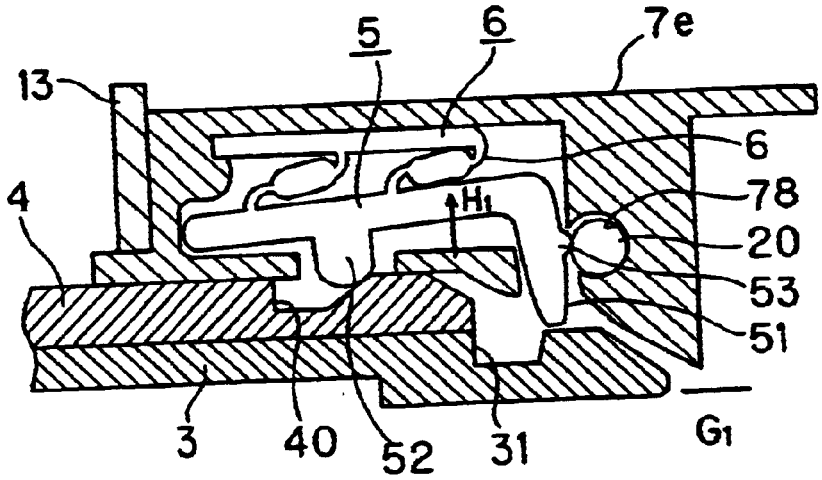
Figure 17C:
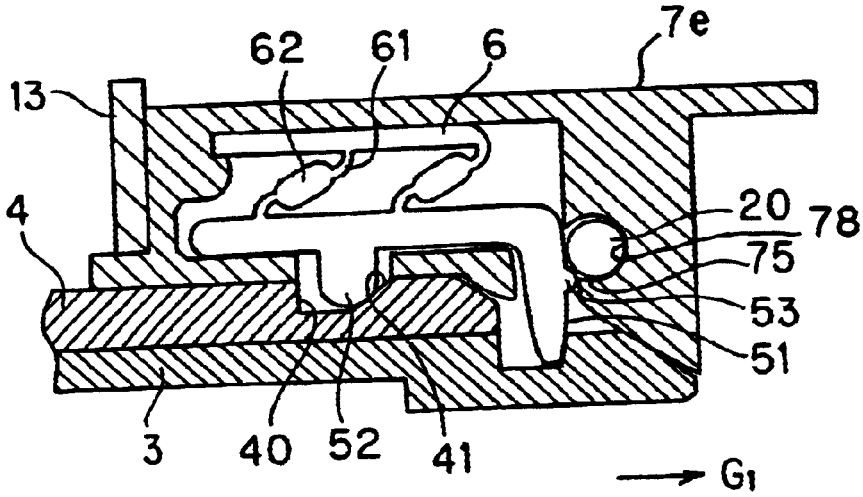

As shown in FIGS. 17A to 17C, a receptacle 7*e* having a spherical guide ball housing portion 78 provided near a rotation guide portion 71 close to the right end in FIGS. 17A to 17C is used as the receptacle 7. A spherical lock member guide ball 20 is accommodated in this guide ball housing portion 78.

A lock member 5*e* having a protrusion 53 provided at a middle position on the outer side of a plug engagement pawl 51 at the distal end is used. This lock member 5*e* is substantially the same as the lock member having ordinary two consecutive Z springs integrally molded thereon, except for the protrusion 53.

The lock member guide ball 20 is rotatably housed in the guide ball housing portion 78.

It is also possible to use a cylindrical roll instead of the spherical lock member guide ball 20.

Figure 18A:
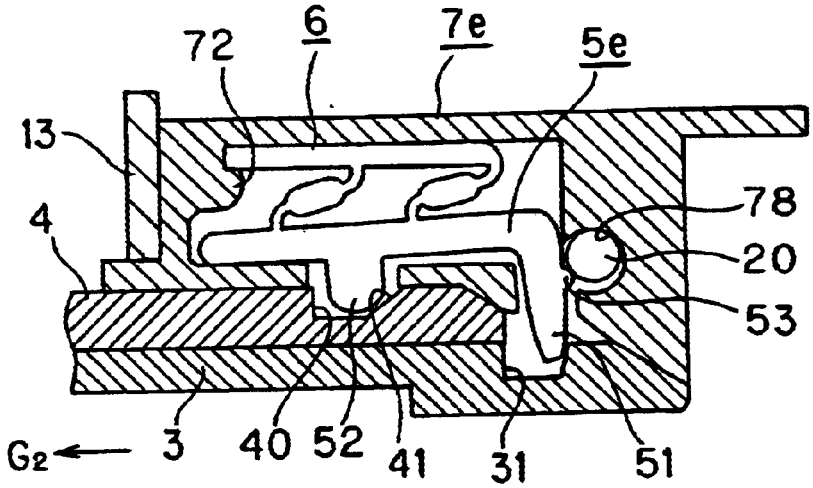
FIGS. 18A to 18C are side views showing the operation steps in the case of extracting the plug unit inserted in the receptacle unit.
Figure 18B:
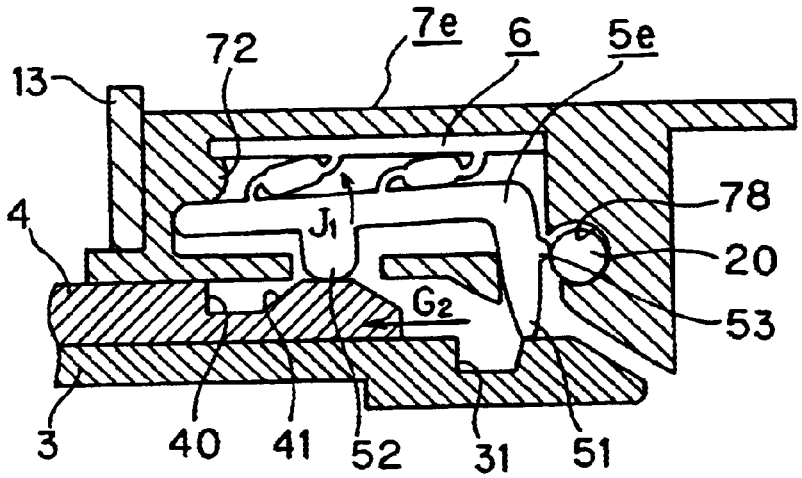
Figure 18C:
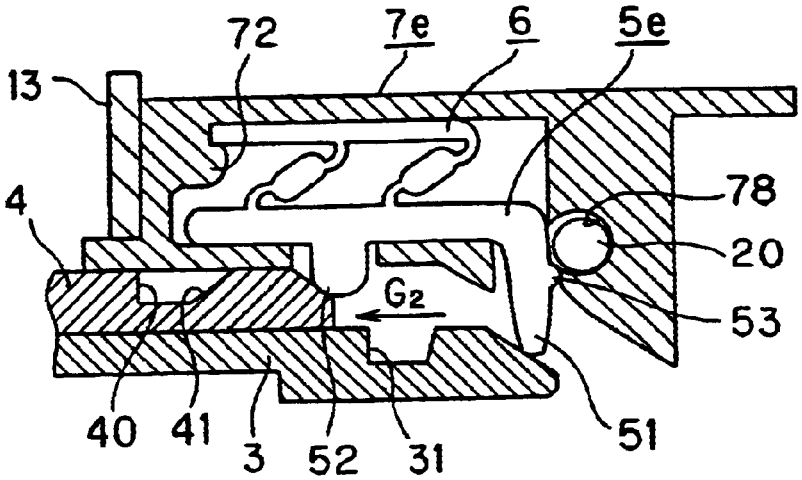

FIGS. 17A to 17C show the step of inserting the plug unit P into the receptacle unit R, and FIGS. 18A to 18C show the step of extracting the plug unit P from the receptacle unit R. FIGS. 17A to 17C and FIGS. 18A to 18C is similar to FIGS. 9A to 10E in the manner of description and show cross sections of the upper half of the receptacle 7 and the upper halves of the connector plug 3 and the unlocking member 4 of the plug unit P.

In FIG. 17A, insertion of the plug unit P into the receptacle unit R is started. The tapered portion 4*a* of the unlocking member 4, at the right end in FIG. 17A, is abutted against the press operator 52, and the distal end side of the connector plug 3 is abutted against the plug engagement pawl 51. The lock member 5*e* remains lowered horizontally near the connector plug 3.

The protrusion 53 provided on the plug engagement pawl 51 of the lock member 5*e* is situated on the lower side of the lock member guide ball 20.

When the plug unit P is further inserted and reaches the state shown in FIG. 17B, the tapered portion 4*a* on the distal end side of the unlocking member 4 pushes up the press operator 52 in the direction of an arrow H1 in FIG. 17B. The distal end of the lock member 5, at the right end in FIG. 17B, is raised and the plug engagement pawl 51 is detached from the engagement pawl engagement groove 31 provided on the distal end side of the connector plug 3.

The protrusion 53 of the lock member 5*e* goes aground on the lock member guide ball 20 and moves upward in FIG. 17B along the lock member guide ball 20.

FIG. 17C shows a step 3 where the insertion of the plug unit P into the receptacle unit R is completed. The tapered portion 35 at the distal end of the connector plug 3 is fully in contact with the tapered portion 75 of the plug insertion hole 70 provided in the receptacle unit R, and the plug engagement pawl 51 of the lock member 5 pushes the connector plug 3 in the direction of an arrow G1 in FIG.

17C. The protrusion 53 of the lock member 5*e* moves downward again from the upper side of the lock member guide ball 20.

With reference to FIGS. 18A to 18C, the step of extracting the plug unit P inserted in the receptacle unit R will now be described.

In FIG. 18A, the knob portion 12 is held by fingers and the unlocking member 4 is moved in the direction of an arrow G2 in FIG. 18A. The press operator 52 of the lock member 5*e* is abutted against the inclined surface portion 41 in the cam groove 40 and the lock member 5*e* is slightly turned in such a direction that the plug engagement pawl 51 on the distal end side is detached from the engagement pawl engagement groove 31 of the connector plug 3.

The protrusion 53 of the lock member 5*e* is situated on the lower side of the lock member guide ball 20.

When the unlocking member 4 is further moved in the direction of an arrow G2 in FIG. 18B, the quantity of pushing up the press operator 52 reaches the maximum. While the left end of the lock member 5*e* as shown in FIG. 18B is abutted against the movable range regulating portion 72, the lock member 5*e* is rotated in the direction of an arrow J1 in FIG. 18B with respect to this position as the pivotal point and takes such a posture that the right side is up in FIG. 18B. The Z springs 6 are compressed to the maximum extent. The plug engagement pawl 51 leaves the engagement pawl engagement groove 31 of the connector plug 3 and the connector plug 3 moves in the direction of the arrow G2 in FIG. 18B together with the unlocking member 4.

The protrusion 53 of the lock member 5*e* moves upward over the lock member guide ball 20.

On completion of the extraction of the plug unit P from the receptacle unit R, the unlocking member 4 and the connector plug 3 can move without being constrained by the lock member 5, as shown in FIG. 18C. In this case, the lock member 5*e* is pushed by the Z springs 6 and has its entire surface abutted against the lower side of the lock member housing portion 74, thus restoring the same initial state as shown in FIG. 17A. The protrusion 53 of the lock member 5*e* moves downward again from the upper side of the lock member guide ball 20.

In this manner, when the protrusion 53 moves over the lock member guide ball 20, the lock member 5*e* is rotated while it is also horizontally moved. Thus, the above-described hysteresis characteristic is provided.

Also in the example shown in FIGS. 13A and 13B where the ring-shaped spring 6 is employed, the operation is substantially similar to the above-described operation and the effect of the lock member guide ball 20 is sufficiently exhibited.

As described above, the engagement of the lock member guide pin with the lock member guide groove, or the engagement of the protrusion of the lock member with the lock member guide ball enables the lock member to take a predetermined position and posture at the insertion/extraction step, and effective holding of the connector plug and the like can be realized.

Moreover, the user who carries out the operation to connect the cable can feel it comfortable to have a distinct touch in the instant of locking during the connector plug insertion process.

Meanwhile, in the connection device according to the present invention, the unlocking member 4 is attached to the connector plug 3 so as to be movable in the direction of the axial core of the cable, that is, in the axial direction of the connector plug. Specifically, the unlocking member 4 is movable in the direction of an arrow D1 and in the direction of an arrow D2 in FIG. 5 within the range of the void constituted in the housing recess 14 for housing the plug movement range regulating member 11 provided on the knob portion 12. As a result, while the connector plug 3 is locked to the lock member 5, the unlocking member 4 and the knob portion 12 fixed to the unlocking member 4 have a small margin in the direction of the axial core of the cable, that is, in the directions of the arrow D1 and D2 in FIG. 5, and the user might be given a sense of instability.

As a countermeasure for this, it is conceivable to add a click mechanism to fix the unlocking member 4.

Figure 19:
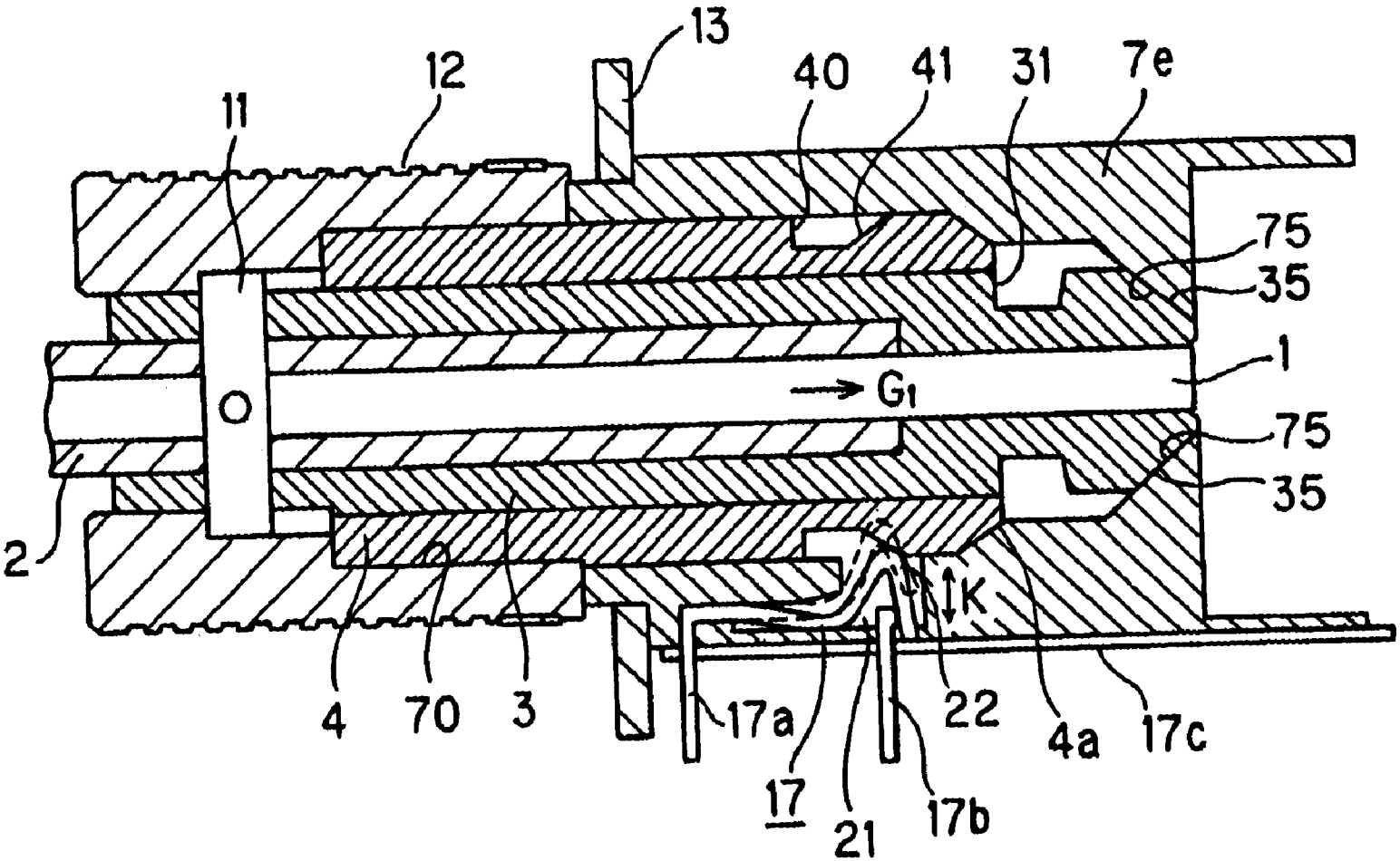
FIG. 19 is a cross-sectional view showing the connection device having a plug insertion detection switch which provides a clicking touch when inserting/removing the plug unit to/from the receptacle unit.

An example in which a click mechanism is provided will now be described with reference to FIG. 19. In the connection device shown in FIG. 19, a plug detection switch which is conventionally used also serves as a click mechanism. FIG. 19 is a cross-sectional view of the receptacle 7*e* as viewed on the horizontal plane when the plug unit P is inserted in the receptacle unit R. FIG. 19 shows a cross section at a position rotated 90 degrees from the cross section shown in FIG. 5 and along a plane containing the axial core of the optical cable 2.

In the connection device shown in FIG. 19, a printed board 17*c* on which a contact spring 17*a* and a fixed contact 17*b* constituting a plug insertion detection switch 17 are mounted is attached to a lateral side of the receptacle 7*e*. A housing portion 21 for housing the contact spring 17*a* and the fixed contact 17*b* is formed at a predetermined position in the receptacle 7*e*. This housing portion 21 extends to the plug insertion hole 70 into which the unlocking member 4 is inserted.

The contact spring 17*a* is formed by bending a metallic thin plate into a predetermined shape and has its proximal part, on the left side in FIG. 19, inserted and fixed in a hole of the printed board 17*c*. When no external force is applied, a bent top portion 22 of the contact spring 17*a*, which is an engagement portion, is inside the plug insertion hole 70 in which the unlocking member 4 is inserted, as indicated by a broken line in FIG. 19. When pushed, the top portion 22 is moved by its own elasticity in the direction of an arrow K in FIG. 19, that is, in the vertical direction.

The fixed contact 17*b* has a contact formed on its upper part and is fixed to the printed board 17*c*. When the contact spring 17*a* is moved to a position indicated by a solid line in FIG. 19, the distal end of the contact spring 17*a*, on the right side in FIG. 19, contacts the contact of the fixed contact 12*b* and makes electric conduction.

In the connection device shown in FIG. 19, when the plug unit P is inserted in the receptacle unit R, the tapered portion 4*a* formed at the distal end of the unlocking member 4 starts pushing the top portion 22 of the contact spring 17*a* downward. As the unlocking member 4 is inserted rightward in the direction of an arrow G1 in FIG. 19, the contact spring 17*a* is further pushed down and the distal end of the contact spring 17*a*, on the right side in FIG. 19, contacts the contact of the fixed contact 17*b*, thus sending a plug insertion detection signal to outside.

On completion of the insertion of the plug unit P, the top portion 22 of the contact spring 17*a* contacts the inclined surface portion 41 of the cam groove 40 of the unlocking member 4. Since the contact spring 17*a* is energized by its own elasticity into the direction of protruding in the plug insertion hole 70, the contact spring 17*a* pushes the inclined surface portion 41 of the cam groove 40 of the unlocking member 4 inserted into the plug insertion hole 70, and a component of its force in the axial direction of the cable pushes the unlocking member 4 rightward in the direction of the arrow G1 in FIG. 19. Thus, the tapered portion 4*a* at the distal end of the unlocking member 4 is caused to tightly contact the tapered portion 75 on the side of the receptacle 7*e* and the play of the unlocking member 4 can be eliminated.

In the connection according to the present invention, as described above, when the plug unit P is inserted in the receptacle unit R, the plug engagement pawl 51 of the lock member 5 is engaged with the engagement pawl engagement groove 31 of the connector plug 3, thus fixing the plug unit P at a predetermined inserting position to the receptacle unit R.

As the plug unit P inserted and fixed in the receptacle unit R is pulled out from the receptacle unit R by holding the knob portion 12 mounted integrally on the unlocking member 4, the connector plug 3 can be extracted from the side of the receptacle unit R after the connector plug 3 locked by the lock member 5 is unlocked by the unlocking member 4 mounted movably on the connector plug 3. By carrying out such an extracting operation, the plug unit P can be safely and securely extracted from the receptacle unit R without applying a large load to the connector plug 3 of the plug unit P or the lock member 5 of the receptacle unit R.

Meanwhile, since the plug unit P is adapted for being connected to the receptacle unit R and used for transmitting and receiving signals to and from the electronic equipment on which the receptacle unit R is provided, the optical cable 2 for transmitting and receiving signals is led out from the plug unit P. The optical cable 2 is led out from the connector plug 3. As a result, there is a risk that the plug unit P inserted in the receptacle unit R might be extracted by holding the optical cable 2 instead of the knob portion 12. Moreover, when the plug unit P is connected with the electronic equipment, a force in the extracting direction might be applied to the optical cable 2 extended from the plug unit P. If such an extraction force is applied to the other parts than the knob portion 12, there is a risk that the extraction force is applied directly to the connector plug 3 and might damage the lock mechanism of the connector plug 3 including the lock member 5.

An example of the connection device will now be described which enables prevention of damage to the lock mechanism or the like of the connector plug 3 including the lock member and protection of the plug unit P and the receptacle unit R even when careless extraction of the plug unit P as described above is carried out.

In the following description, the parts common to the above-described example are denoted by the same numerals and will not be described further in detail.

Figure 20:
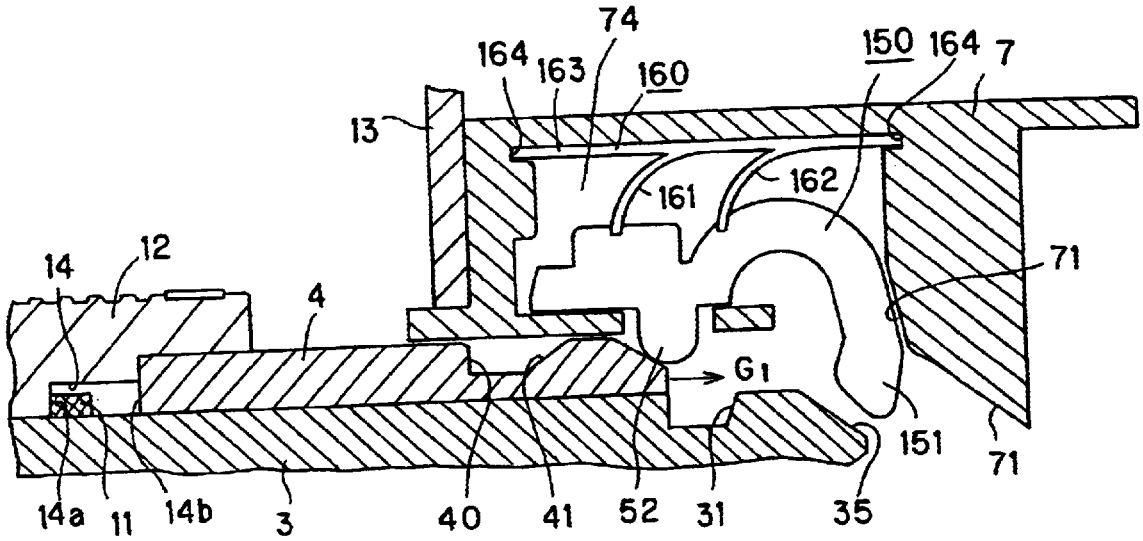
FIG. 20 is a side view showing essential portions of still another example of the connection device according to the present invention.

In the connection device of this example according to the present invention, a plug engagement pawl 151 which is provided on a lock member 150 and is to be engaged with the engagement pawl engagement groove 31 of the connector plug 30 so as to lock the connector plug 3 at an inserting position to the receptacle unit R is made elastically displaceable, as shown in FIG. 20. The lock member 150 is made of an elastically displaceable synthetic resin material and the plug engagement pawl 151 is largely curved. The largely curved plug engagement pawl 151 is easily flexibly deformed in the curving direction.

In this example, since a flexible deformation force is applied to the plug engagement pawl 151, the lock member 150 is made of an elastically displaceable synthetic resin material. Therefore, the Z springs as described above for providing a force in the direction of compression-bonding the lock member 150 to the connector plug 3 and compression-bonding the connector plug 3 to the tapered portion 75 on the side of the receptacle unit R cannot be provided integrally on the lock member 150.

Figure 21:
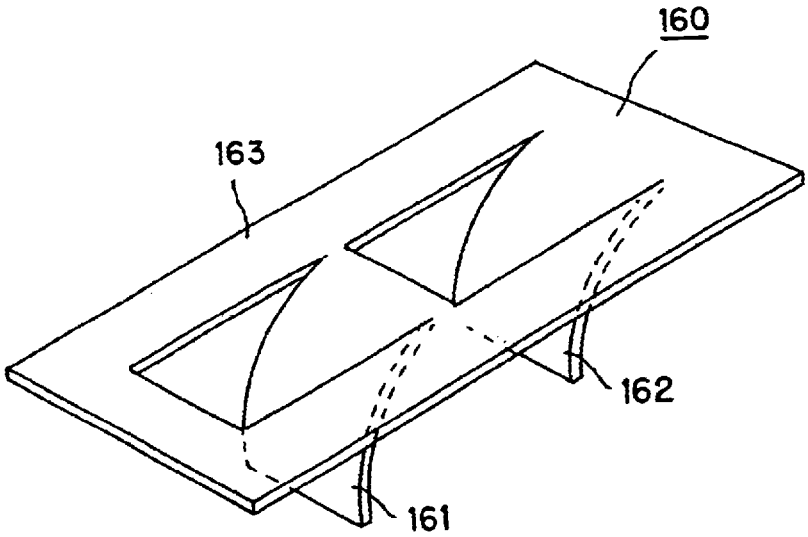
FIG. 21 is a perspective view showing a Z spring for energizing the lock member.

Thus, a Z spring 160 for energizing the lock member 150 is formed as a separate member from the lock member 150. The Z spring 160 used in this example is formed by providing a pair of rise tabs 161, 162 on a thin metallic leaf spring, as shown in FIG. 21. The Z spring 160 is connected to the lock member 150 by inserting the distal ends of the rise tabs 161, 162 to the back side of the lock member 150. When the Z spring 160 connected to the lock member 150 is housed in the lock member housing portion 74 provided in the receptacle 7 together with the lock member 150, the Z spring 160 is attached to the receptacle 7 by inserting both ends of a flat board 163 of the Z spring 160 into insertion grooves 164 provided on the bottom side of the lock member housing portion 74.

The pair of rise tabs 161, 162 of the Z spring 160 are curved so as to apply a force in the direction of compression-bonding the lock member 150 to the connector plug 3 and compression-bonding the connector plug 3 to the tapered portion 75 on the side of the receptacle unit R, and its curvature is selected to provide a suitable compression-bonding force.

Again, in the connection device thus constituted, in order to connect the plug unit P to the receptacle unit R, the knob portion 12 is held and the distal end side of the connector plug 3 is inserted into the plug insertion hole 70 in the receptacle unit R, as shown in FIG. 20, similarly to the previously described connection device.

In this case, the plug movement range regulating member 11 attached on the connector plug 3 is abutted against one lateral surface 14*a* of the housing recess 14 of the knob portion 12, and the unlocking member 4 and the connector plug 3 are integrally inserted in the inserting direction indicated by an arrow G1 in FIG. 20.

As the plug unit P is further inserted into the receptacle unit R from the state where the distal end side of the connector plug 3 is inserted in the plug insertion hole 70, the press operator 52 provided on the lock member 150 goes aground at the highest position on the outer circumferential surface of the unlocking member 4, that is, the portion of the largest diameter. The lock member 150 is rotated in the direction of an arrow J1 in FIG. 22A and has its insertion end side lifted up. The plug engagement pawl 151 is moved to a position away from the engagement pawl engagement groove 31 of the connector plug 3.

Figure 22A:
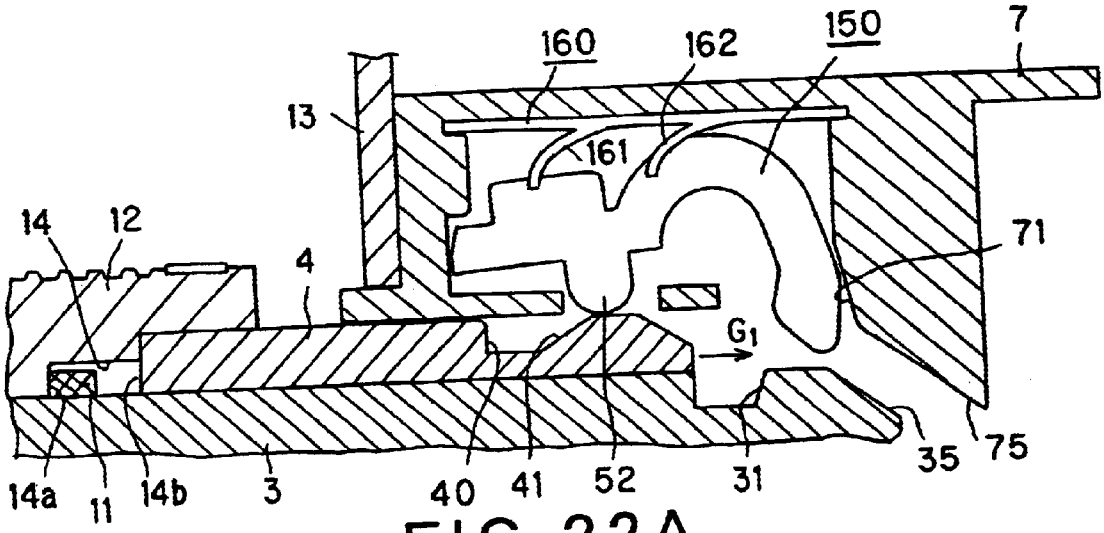
FIGS. 22A to 22C are side views showing the state where the plug unit is inserted into the receptacle unit.
Figure 22B:
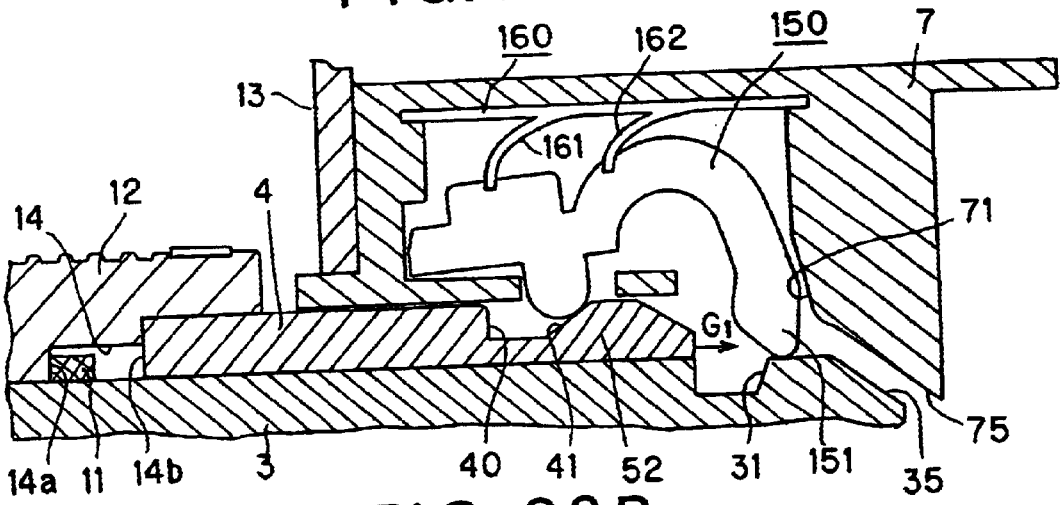

When the plug unit P is further inserted into the receptacle unit R from the state shown in FIG. 22A, the press operator 52 goes aground on the inclined surface portion 41 formed in the cam groove 40, and the plug engagement pawl 151 is abutted against the outer circumferential surface of the connector plug 3, thus supporting lock member 150, as shown in FIG. 22B.

Figure 22C:
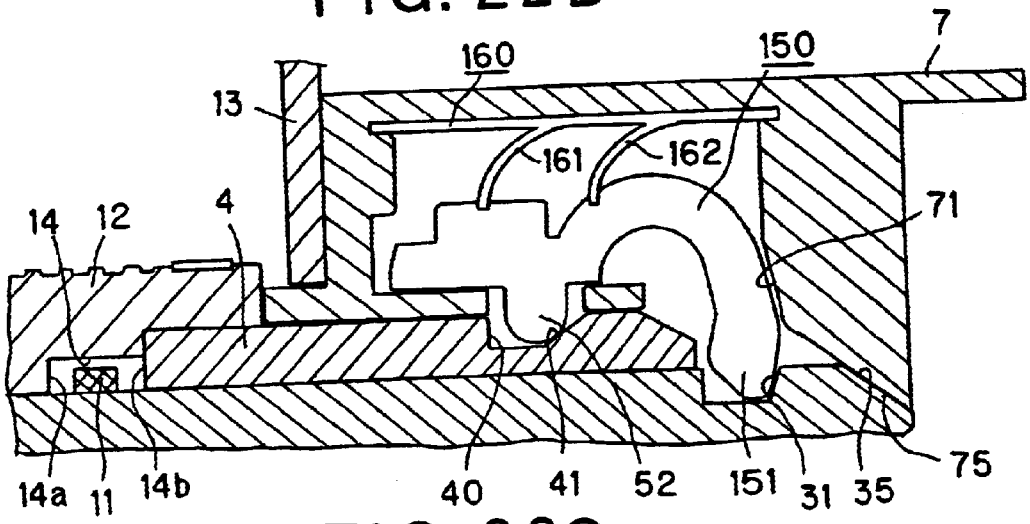

When the plug unit P is inserted to the position shown in FIG. 22C, the other end side of the lock member 150 which is opposite to the side where the plug engagement pawl 151 is provided is lowered and abutted against the lower side of the lock member housing portion 74. In this case, the lock member 150 is guided by the rotation guide portion 71 and is moved as a whole in the direction of an arrow G2 in FIG. 22C so that the plug engagement pawl 151 can easily fall in the engagement pawl engagement groove 31 of the connector plug 3.

As the plug unit P is fully inserted in the receptacle unit R, the engagement pawl 151 falls in the engagement pawl engagement groove 31 of the connector plug 3, and the tapered portion 35 at the distal end of the connector plug 3 is fully in contact with the tapered portion 75 provided in the plug insertion hole 70, as shown in FIG. 22C. An energizing force of the Z spring 160 in the axial direction, that is, an energizing force in the direction of an arrow G1 in FIG. 22C, causes the lock member 150 to be guided by the rotation guide portion 71 and moved in the direction of the arrow G1 in FIG. 22C. The plug engagement pawl 151 is thus energized in the direction of an arrow L1 in FIG. 22C to press the connector plug 3.

In this manner, since the energizing force of the Z spring 160 causes the plug engagement pawl 151 to press and energize the connector plug 3 in the directions of the arrows G1 and L1 in FIG. 22C toward the tapered portion 75 of the receptacle unit R even after the completion of the insertion, the inserting position of the connector plug 3 with respect to the receptacle unit R is constantly held. Since the connector plug 3 is held at the predetermined position, constant relative positions of the optical fiber 1 on the side of the plug unit P and the optical element 8 on the side of the electronic equipment are maintained, and accurate transmission and reception of signals can be carried out.

Figure 23A:
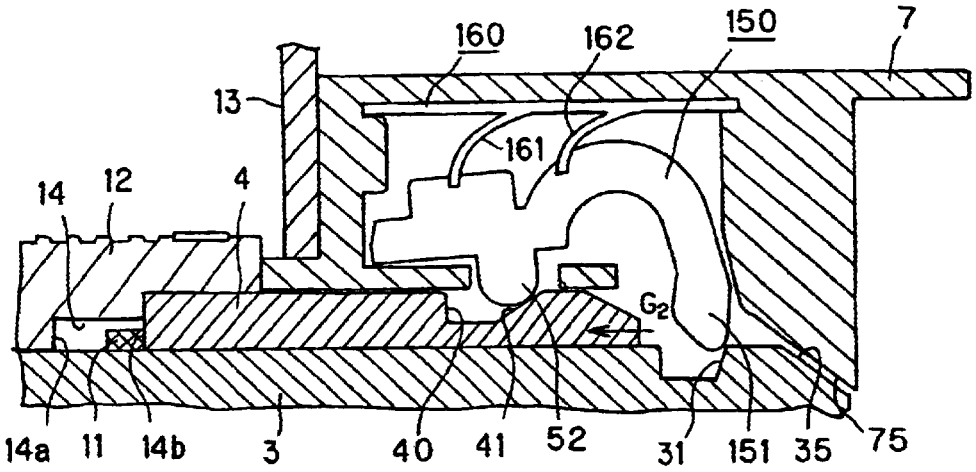
FIGS. 23A to 23C are side views showing the state where the plug unit inserted in the receptacle unit is extracted.

As described above, in order to extract the plug unit P inserted in the receptacle unit R, the knob portion 12 is held and the unlocking member 4 is pulled out together with the knob portion 12 leftward in the direction of an arrow G2 in FIG. 23A. When the unlocking member 4 is pulled out, the press operator 52 of the lock member 150 goes aground on the inclined surface portion 41 in the cam groove 40. In this case, the unlocking member 4 moves in the direction of the arrow G2 in FIG. 23A slightly ahead of the connector plug 3, and the plug movement range regulating member 11 attached to the connector plug 3 is abutted against the other lateral surface 14*b* of the housing recess 14 of the knob 12. The unlocking member 4 and the connector plug 3 integrally move in the extracting direction indicated by the arrow G2 in FIG. 23A.

Figure 23B:
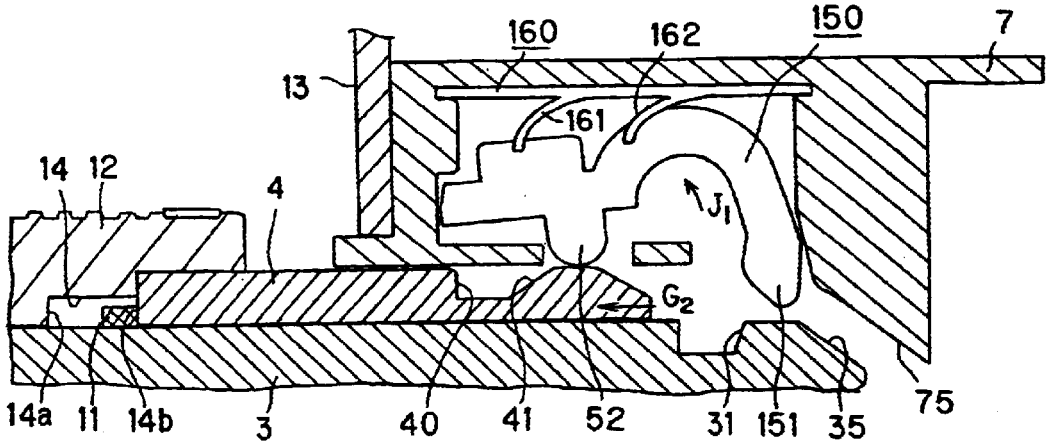

When the unlocking member 4 is further moved in the direction of an arrow G2 in FIG. 23B, the press operator 52 is pushed up by the inclined surface portion 41 of the cam groove 40 and the lock member 150 is turned in the direction of an arrow J1 in FIG. 23B. At this point, the Z spring 160 is compressed.

When the unlocking member 4 is further moved in the direction of the arrow G2 in FIG. 23B, the quantity of pushing up the press operator 52 reaches the maximum. The lock member 150 is turned in the direction of the arrow J1 in FIG. 23B and takes such a posture that the right side is up with the plug engagement pawl 151 of the distal end moved away from the connector plug 3. At this point, the Z spring 160 is compressed to the maximum extent. The plug engagement pawl 151 leaves the engagement pawl engagement groove 31 of the connector plug 3, and the connector plug 3 moves in the direction of the arrow G2 in FIG. 23B together with the unlocking member 4.

Figure 23C:
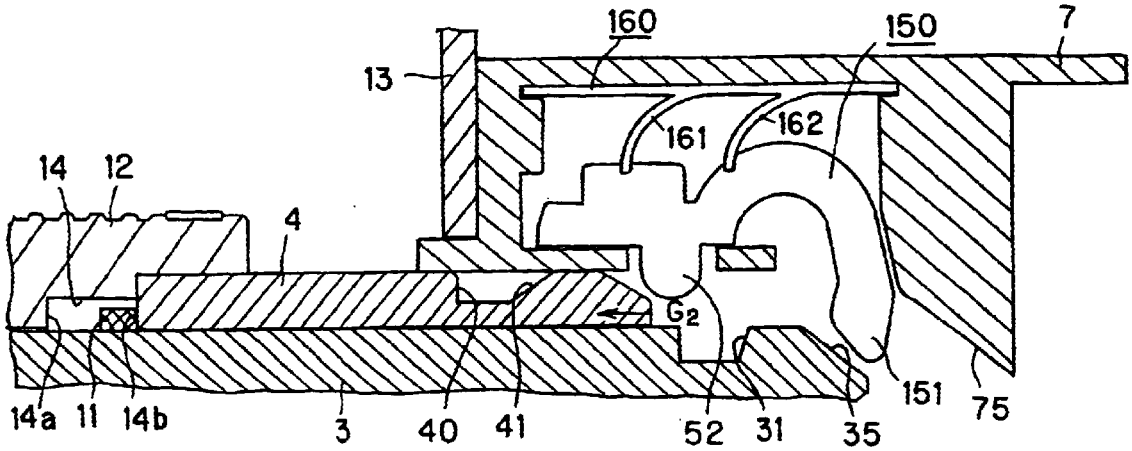

As the plug unit P is further pulled out from the receptacle unit R in the extracting direction indicated by the arrow G2 in FIG. 23B, the unlocking member 4 and the connector plug 3 are freely movable without being constrained by the lock member 150, as shown in FIG. 23C. In this case, the lock member 150 is pushed by the Z spring 160 and restores the initial state in which its entire surface is abutted against the lower side of the lock member housing portion 74.

Meanwhile, in this connection device, when the plug unit P is inserted in the receptacle unit R, even if a load is directly applied to the optical cable 2 and the optical cable 2 is pulled out without holding the knob portion 12, the plug engagement pawl 151 is elastically deformed and hence absorbs the load applied to the optical cable 2. Therefore, it is possible to prevent application of a large load to the mechanism for locking the connector plug 3 such as the lock member 150.

The operation in the case where the optical cable 2 is pulled out will be described hereinafter.

Figure 24A:
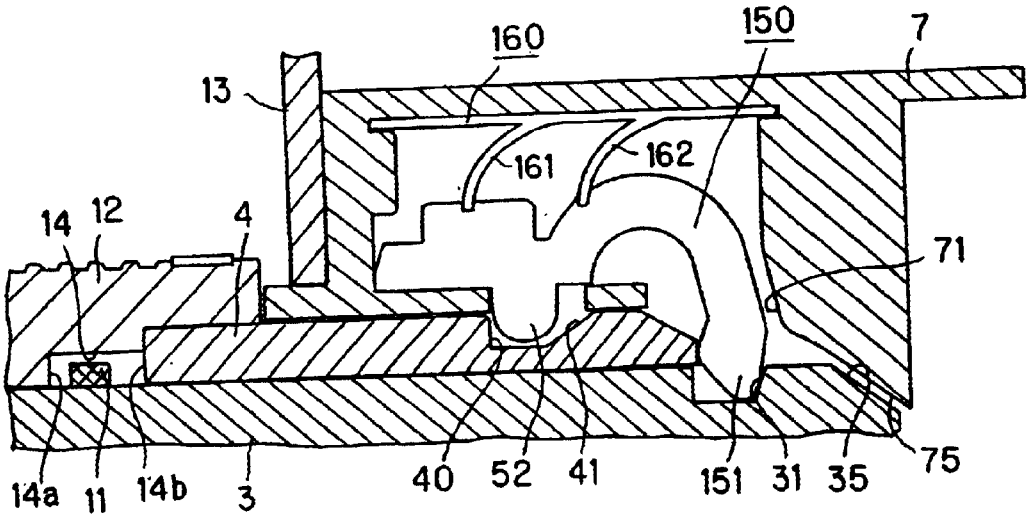
FIGS. 24A to 24C are side views showing the state where the plug unit is pulled out by holding the optical cable.

If the optical cable 2 is pulled in the direction of an arrow G2 in FIG. 24A when the plug unit P is inserted in the receptacle unit R, the connector plug 3 is moved in the same direction separately from the unlocking member 4. In this case, the plug engagement pawl 151 engaged with the engagement pawl engagement groove 31 of the connector plug 3 is pressed by the rising surface 31*a* of the engagement pawl engagement groove 31 and flexibly deformed in the direction of an arrow J1 in FIG. 24B.

Figure 24B:
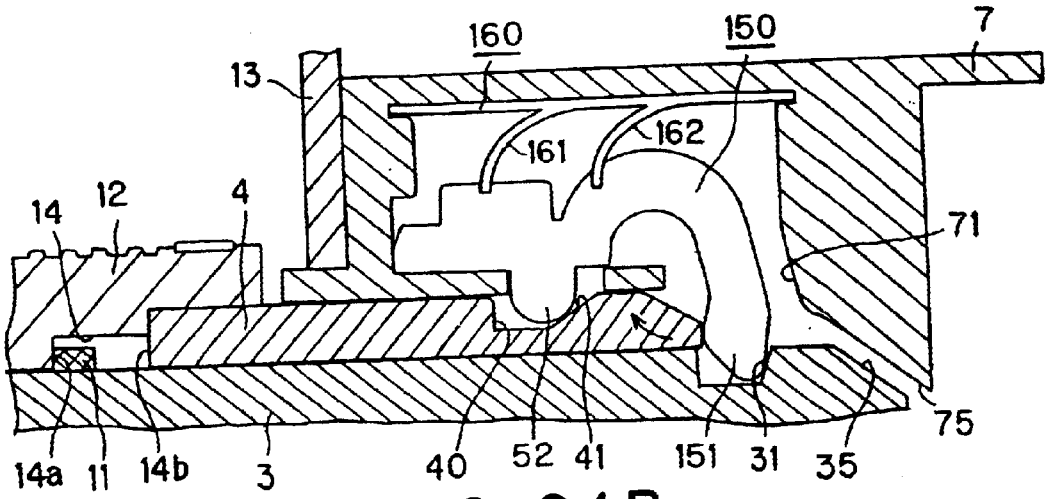

The plug movement range regulating member 11 attached to the connector plug 3 is abutted against the one lateral surface 14*a* of the housing recess 14 of the knob portion 12, and the unlocking member 4 and the connector plug 3 integrally move in the extracting direction indicated by an arrow G2 in FIG. 24B.

Figure 24C:
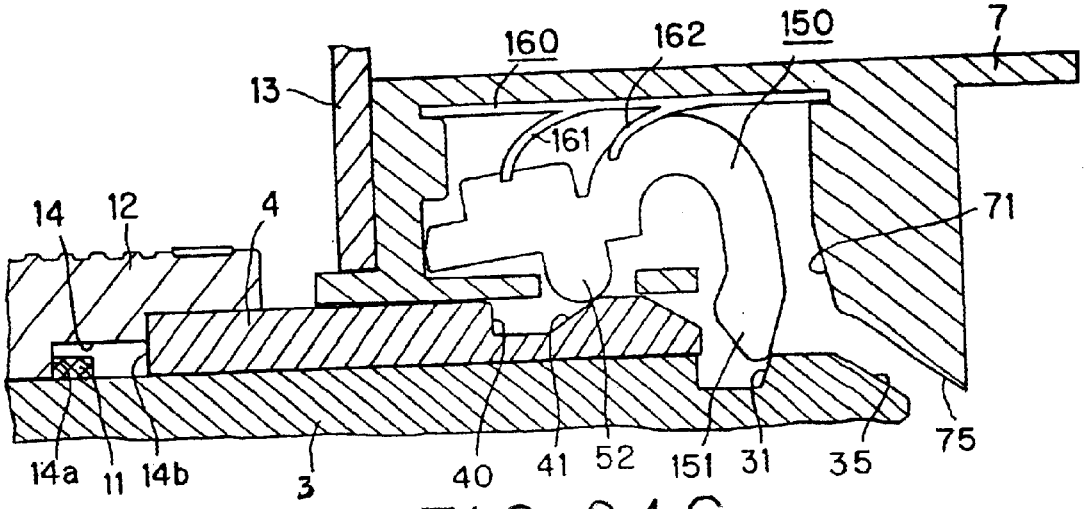

When the optical cable 2 is further pulled out from this state, the connector plug 3 moves in the extracting direction indicated by an arrow G2 in FIG. 24C while flexing the plug engagement pawl 151, and the unlocking member 4 moves in the same direction. As the unlocking member 4 moves integrally with the connector plug 3 in the extracting direction indicated by the arrow G2 in FIG. 24C, the press operator 52 is pushed up over the inclined surface portion 41 of the cam groove 40 and the lock member 150 is turned in the direction of an arrow J1 in FIG. 24C, thus detaching the plug engagement pawl 151 on the distal end side from the connector plug 3. As the plug engagement pawl 151 is detached from the engagement pawl engagement groove 31 of the connector plug 3, the plug unit P is unlocked from the receptacle unit R, thus enabling extraction of the plug unit P from the receptacle unit R.

In this manner, even if the optical cable 2 is pulled out, the pulling force is absorbed by the elastic displacement of the plug engagement pawl 151 of the lock member 150 and the connector plug 3 is unlocked to enable extraction of the plug unit P from the receptacle unit R. Therefore, it is possible to safely pull out the plug unit P from the receptacle unit R even when an erroneous operation is carried out.

Another example of the connection device will now be described which enables prevention of damage to the lock mechanism or the like of the connector plug including the lock member and protection of the plug unit P and the receptacle unit R even when careless extraction of the plug unit P is carried out.

The following connection device is constituted to realize the various functions of the lock member more satisfactorily. The portion where the plug engagement pawl for locking the connector plug 3 is provided and the portion where the press operator operated by the unlocking member 4 is provided are independently formed, and a Z spring is independently formed as the energizing member for pressing and energizing the lock member.

By thus forming these members independently, it is possible to prevent damage to the lock mechanism of the connector plug and to regulate the inserting position of the plug unit P with respect to the receptacle unit R. Thus, a connection device which can realize accurate transmission and reception of signals can be constituted.

Hereinafter, the connection device in which the respective members are independently constituted will be described with reference to the drawings.

In the following description, the portions common to the above-described example are denoted by the same numerals and will not be described further in detail.

Figure 25:
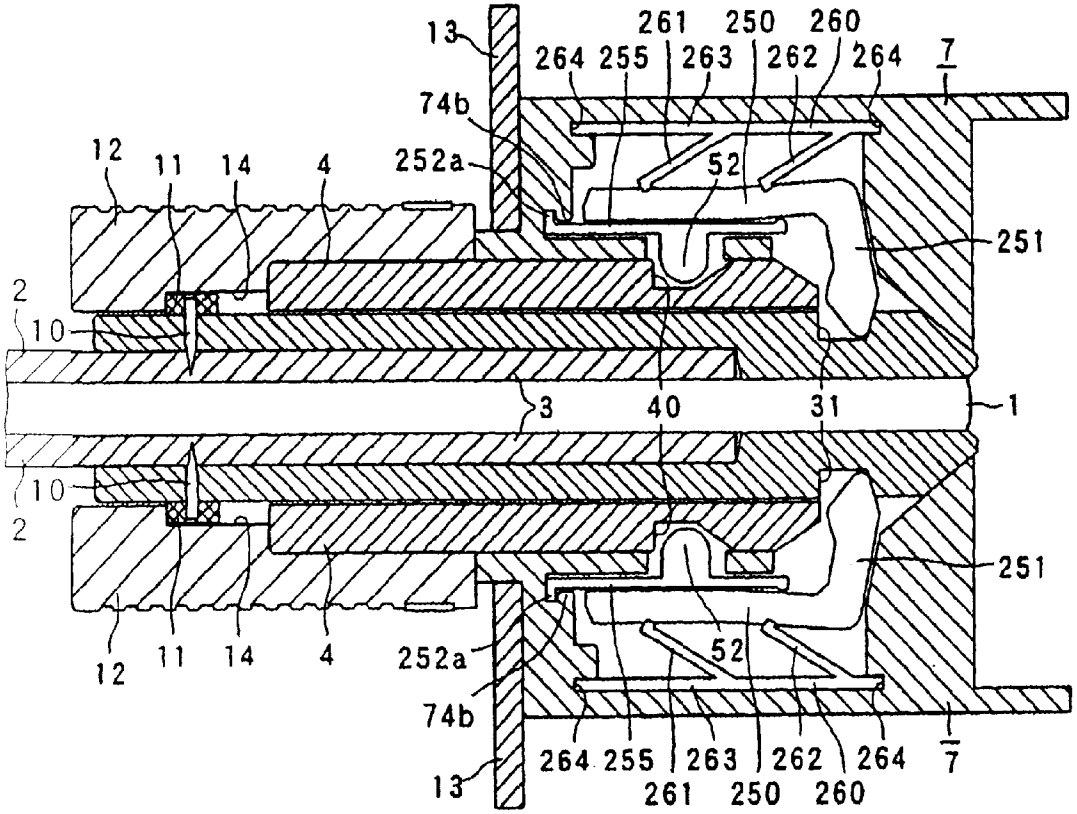
FIG. 25 is cross-sectional side view showing still another example of the connection device according to the present invention.

In the connection device in this example according to the present invention, a lock member 250 having a plug engagement pawl 251 provided on its distal end side which is adapted for being engaged with the engagement pawl engagement groove 31 of the connector plug 3 and locking the connector plug 3 at the inserting position to the receptacle unit R, a movement control member 255 provided on the press operator 52 which is adapted for moving the lock member 250 in association with the insertion of the plug unit P, and a Z spring 260 for energizing the lock member 250, are formed as independent members, respectively, as shown in FIG. 25. In association with the state of being housed in the lock member housing portion 74 provided in the receptacle 7, these members realize the same functions as those of the integrated lock member provided in the above-described connection device.

The lock member 250 is so constituted that the plug engagement pawl 251 for being engaged with the engagement pawl engagement groove 31 of the connector plug 3 and locking the connector plug 3 at the inserting position to the receptacle unit R is elastically displaceable. The lock member 250 is made of an elastically displaceable synthetic resin material, and the plug engagement pawl 251 is largely curved. The largely curved plug engagement pawl 251 is easily flexibly deformed in the curving direction.

Figure 26:
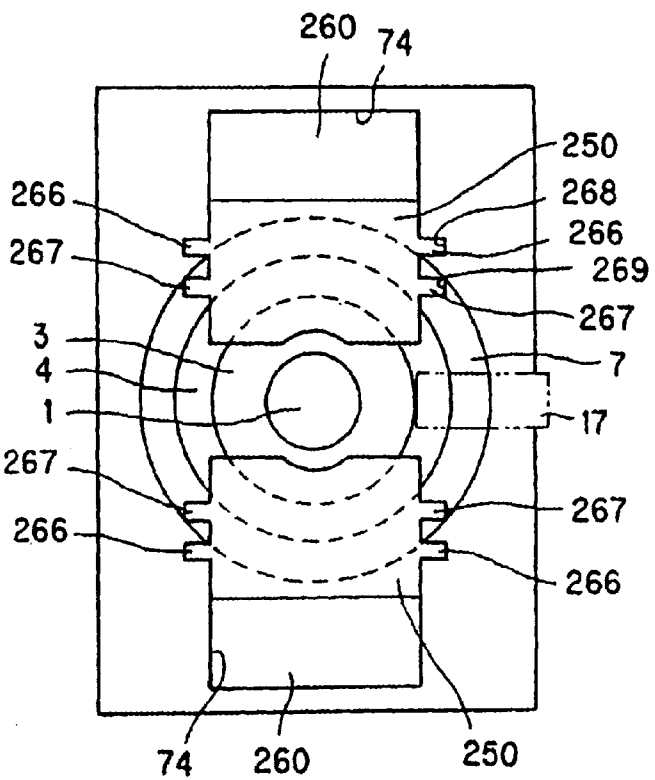
FIG. 26 is a front view of the connection device shown in FIG. 25.

On both lateral sides of the lock member 250, a pair of guide pins 266 and a pair of guide pins 267 are projected, as shown in FIG. 26. These guide pins 266, 267 are engaged with rotation guide grooves 268, 269 formed on the inner wall of the lock member housing portion 74, thereby guiding the rotating direction of the lock member 250.

The movement control member 255 having the press operator 52 projected at its center is made of a synthetic resin material, and is housed in the lock member housing portion 74 in such a manner that it is superimposed on the lock member 250, as shown in FIG. 25. In this case, the movement control member 255 is arranged in the lock member housing portion 74, with its press operator 52 projected into the plug insertion hole 70 from the second through-hole 77. As an engagement piece 252*a* provided at the proximal end of the movement control member 252 is engaged with an engagement groove 74*b* provided in the lock member housing portion 74, the movement of the movement control member in the lock housing portion 74 is regulated.

The Z spring 260 for energizing the lock member 250 is constituted by providing a pair of rise tabs 261, 262 on a thin metallic leaf spring. The Z spring 260 is connected to the lock member 250 by inserting the distal ends of these rise tabs 261, 262 to the back side of the lock member 250. When the Z spring 260 connected to the lock member 250 is housed in the lock member housing portion 74 provided in the receptacle 7 together with the lock member 250, the Z spring 260 is attached to the receptacle 7 by inserting both ends of a flat board 263 of the Z spring 260 into insertion grooves 264 provided on the bottom side of the lock member housing portion 74.

Figure 27A:
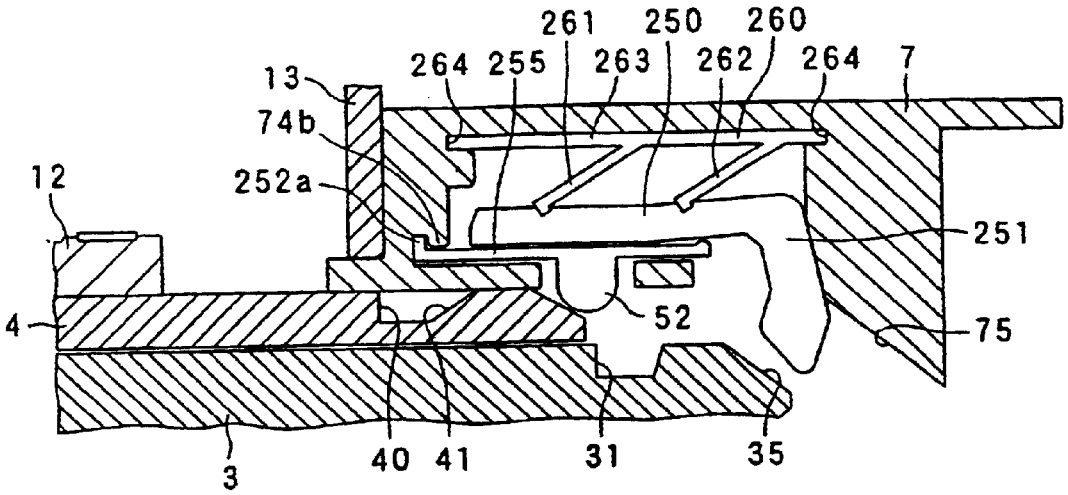
FIGS. 27A to 27D are side views showing the state where the plug unit is inserted into the receptacle unit.

Again, in the connection device thus constituted, in order to connect the plug unit P to the receptacle unit R, the knob portion 12 is held and the distal end side of the connector plug 3 is inserted into the plug insertion hole 70 in the receptacle unit R, as shown in FIG. 27A, similarly to the previously described connection device.

In this case, though not shown, the plug movement range regulating member 11 attached on the connector plug 3 is abutted against one lateral surface 14*a* of the housing recess 14 of the knob portion 12, and the unlocking member 4 and the connector plug 3 are integrally inserted in the inserting direction indicated by an arrow G1 in FIG. 27A.

As the plug unit P is further inserted into the receptacle unit R from the state where the distal end side of the connector plug 3 is inserted in the plug insertion hole 70, the press operator 52 provided on the movement control member 252 goes aground at the highest position on the outer circumferential surface of the unlocking member 4, that is, the portion of the largest diameter. The movement control member 252 is rotated in the direction of an arrow S1 in FIG. 27B about the engagement piece 252*a* on the proximal end side engaged with the engagement groove 74*b* as the pivotal point. As the movement control member 252 is rotated, the lock member 250 superimposed on the movement control member 252 is also rotated in the direction of the arrow S1 in FIG. 27B. In this case, the plug engagement pawl 251 provided on the distal end side of the lock member 250 is moved to a position away from the engagement pawl engagement groove 31 of the connector plug 3.

Figure 27B:
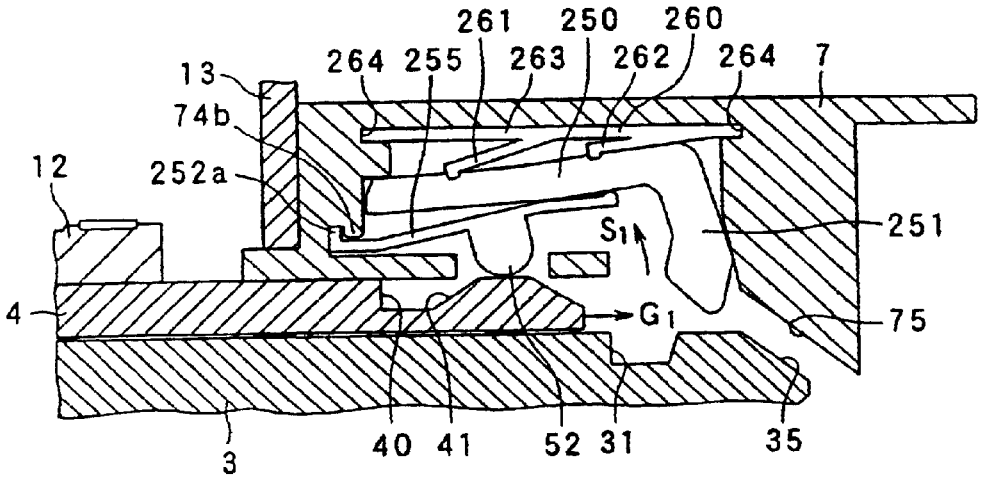
Figure 27C:
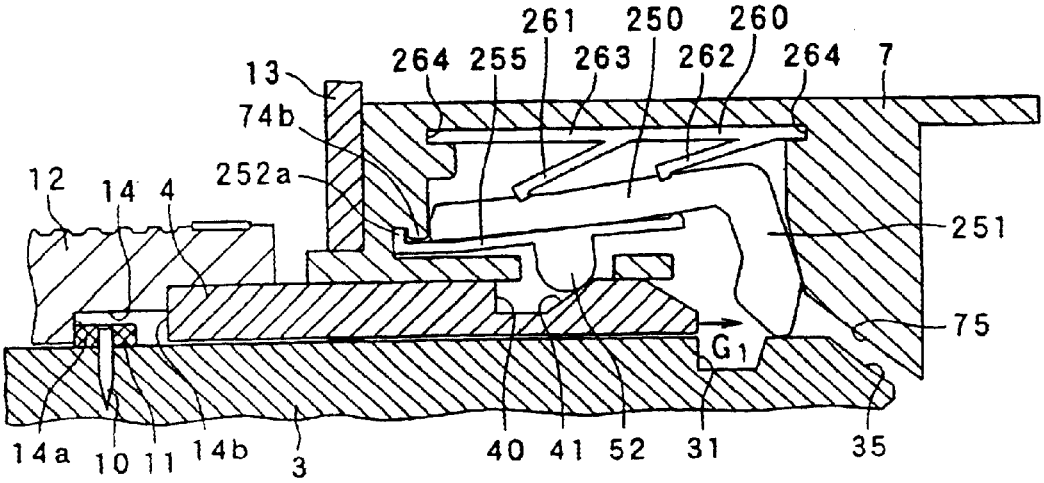

When the plug unit P is further inserted into the receptacle unit R from the state shown in FIG. 27B, the press operator 52 provided on the movement control member 252 goes aground on the inclined surface portion 41 formed in the cam groove 40, and the plug engagement pawl 251 is abutted against the outer circumferential surface of the connector plug 3, thus supporting lock member 250, as shown in FIG. 27C.

Figure 27D:
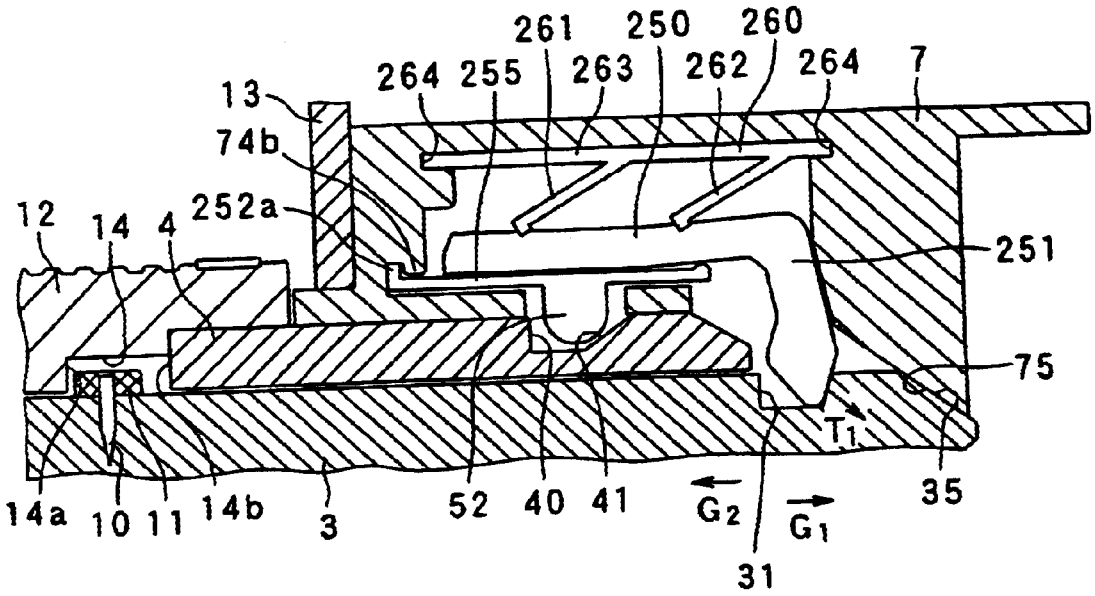

When the plug unit P is inserted to the position shown in FIG. 27D, the other end side of the lock member 250 which is opposite to the side where the plug engagement pawl 251 is provided is lowered together with the movement control member 252 and is abutted against the lower side of the lock member housing portion 74. In this case, the lock member 250 is guided by the rotation guide portion 71 and is moved as a whole in the direction of an arrow G2 in FIG. 27D so that the plug engagement pawl 251 can easily fall in the engagement pawl engagement groove 31 of the connector plug 3.

As the plug unit P is fully inserted in the receptacle unit R, the engagement pawl 251 falls in the engagement pawl engagement groove 31 of the connector plug 3, and the tapered portion 35 at the distal end of the connector plug 3 is fully in contact with the tapered portion 75 provided in the plug insertion hole 70, as shown in FIG. 27D. An energizing force of the Z spring 260 in the axial direction, that is, an energizing force in the direction of an arrow G1 in FIG. 27D, causes the lock member 250 to be guided by the rotation guide portion 71 and moved in the direction of the arrow G1 in FIG. 27D. The plug engagement pawl 251 is thus energized in the direction of an arrow T1 in FIG. 27D to press the connector plug 3.

In this manner, since the energizing force of the Z spring 260 causes the plug engagement pawl 251 to press and energize the connector plug 3 in the directions of the arrows G1 and T1 in FIG. 27D toward the tapered portion 75 of the receptacle unit R even after the completion of the insertion, the inserting position of the connector plug 3 with respect to the receptacle unit R is constantly held. Since the connector plug 3 is held at the predetermined position, constant relative positions of the optical fiber 1 on the side of the plug unit P and the optical element 8 on the side of the electronic equipment are maintained, and accurate transmission and reception of signals can be carried out.

Figure 28A:
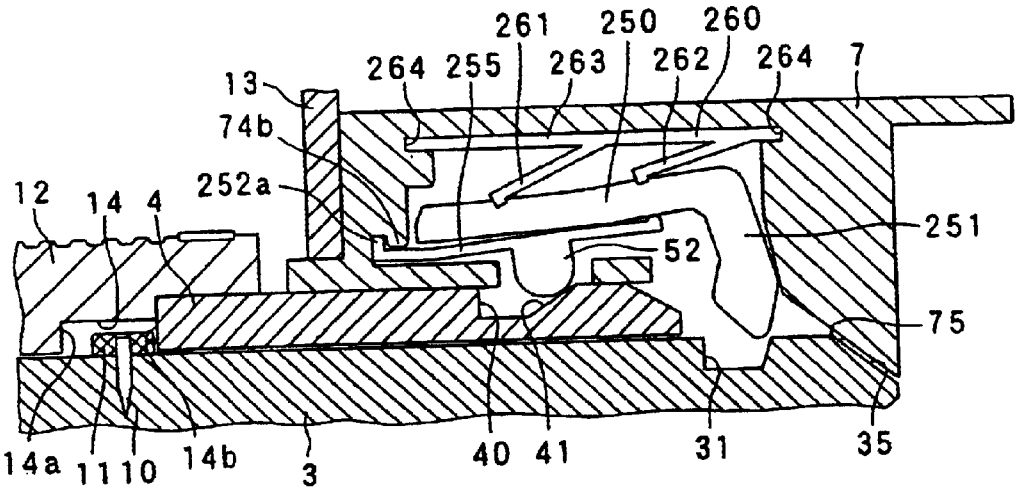
FIGS. 28A to 28C are side views showing the state where the state where the plug unit inserted in the receptacle unit is extracted.

As described above, in order to extract the plug unit P inserted in the receptacle unit R, the knob portion 12 is held and the unlocking member 4 is pulled out together with the knob portion 12 leftward in the direction of an arrow G2 in FIG. 28A. When the unlocking member 4 is pulled out, the press operator 52 of the movement control member 252 goes aground on the inclined surface portion 41 in the cam groove 40. In this case, the unlocking member 4 moves in the direction of the arrow G2 in FIG. 28A slightly ahead of the connector plug 3, and the plug movement range regulating member 11 attached to the connector plug 3 is abutted against the other lateral surface 14*b* of the housing recess 14 of the knob 12. The unlocking member 4 and the connector plug 3 integrally move in the extracting direction indicated by the arrow G2 in FIG. 28A.

Figure 28B:
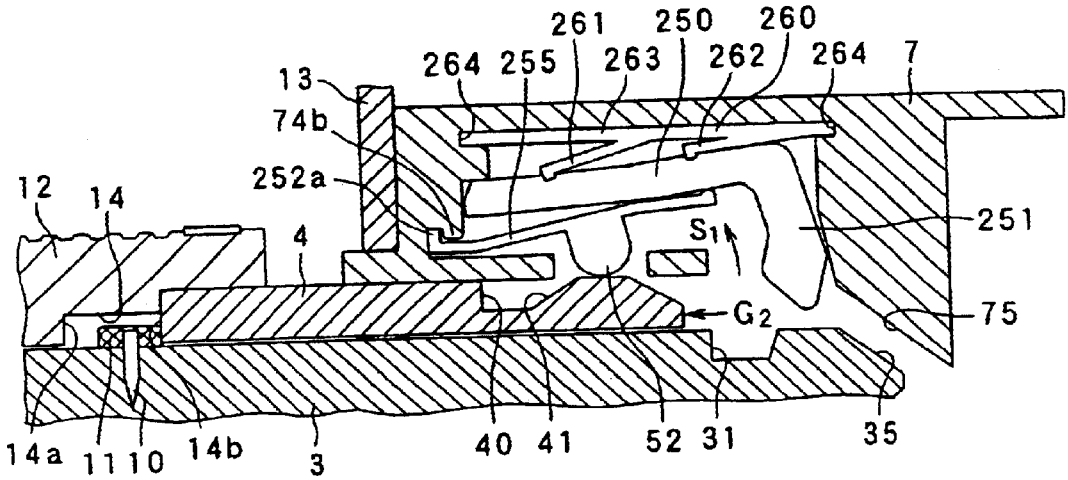

When the unlocking member 4 is further moved in the direction of an arrow G2 in FIG. 28B, the press operator 52 is pushed up by the inclined surface portion 41 of the cam groove 40 and the movement control member 252 is turned in the direction of an arrow S1 in FIG. 28B together with the lock member 250. At this point, the Z spring 260 is compressed.

When the unlocking member 4 is further moved in the direction of the arrow G2 in FIG. 28B, the quantity of pushing up the press operator 52 reaches the maximum. The lock member 250 is pressed by the movement control member 252 and is thus turned in the direction of the arrow S1 in FIG. 28B, thus taking such a posture that the right side is up with the plug engagement pawl 251 of the distal end moved away from the connector plug 3. At this point, the Z spring 260 is compressed to the maximum extent. The plug engagement pawl 251 leaves the engagement pawl engagement groove 31 of the connector plug 3, and the connector plug 3 moves in the direction of the arrow G2 in FIG. 28B together with the unlocking member 4.

Figure 28C:
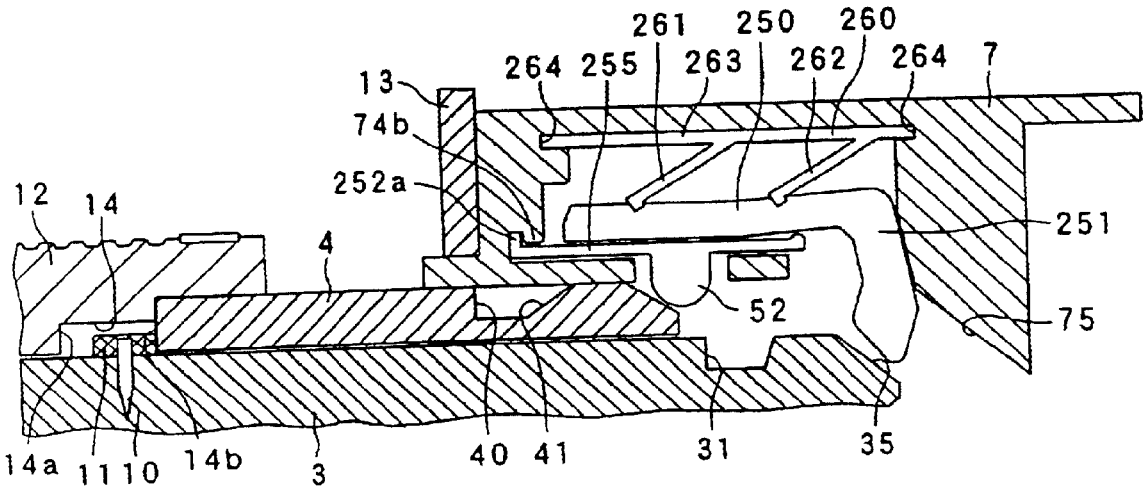

As the plug unit P is further pulled out from the receptacle unit R in the extracting direction indicated by the arrow G2 in FIG. 28B, the unlocking member 4 and the connector plug 3 are freely movable without being constrained by the lock member 250, as shown in FIG. 28C. In this case, the lock member 250 is pushed together with the movement control member 252 by the Z spring 260 and restores the initial state in which its entire surface is abutted against the lower side of the lock member housing portion 74.

Meanwhile, in this connection device, when the plug unit P is inserted in the receptacle unit R, even if a load is directly applied to the optical cable 2 and the optical cable 2 is pulled out without holding the knob portion 12, the plug engagement pawl 251 is elastically deformed and hence absorbs the load applied to the optical cable 2. Therefore, it is possible to prevent application of a large load to the mechanism for locking the connector plug 3 such as the lock member 250.

The operation in the case where the optical cable 2 is pulled out will be described hereinafter.

Figure 29A:
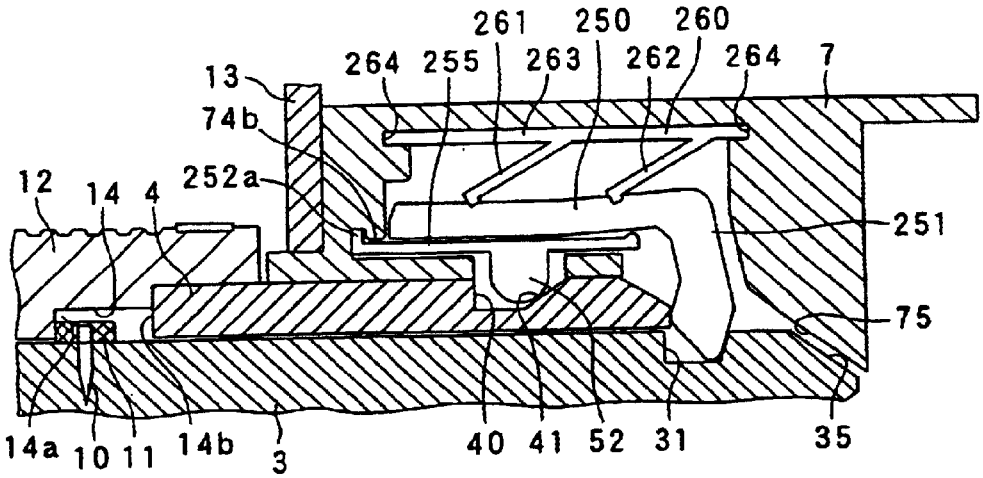
FIGS. 29A to 29C are side views showing the state where the plug unit is pulled out by holding the optical cable.

If the optical cable 2 is pulled in the direction of an arrow G2 in FIG. 29A when the plug unit P is inserted in the receptacle unit R, the connector plug 3 is moved in the same direction separately from the unlocking member 4. In this case, the plug engagement pawl 251 engaged with the engagement pawl engagement groove 31 of the connector plug 3 is pressed by the rising surface 31*a* of the engagement pawl engagement groove 31 and flexibly deformed in the direction of an arrow J1 in FIG. 29B.

Figure 29B:
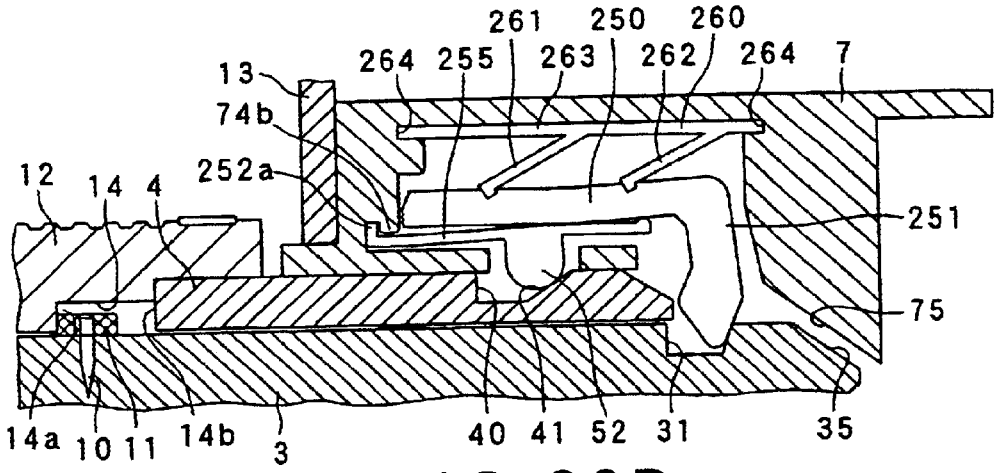

The plug movement range regulating member 11 attached to the connector plug 3 is abutted against the one lateral surface 14*a* of the housing recess 14 of the knob portion 12, and the unlocking member 4 and the connector plug 3 integrally move in the extracting direction indicated by an arrow G2 in FIG. 29B.

Figure 29C:
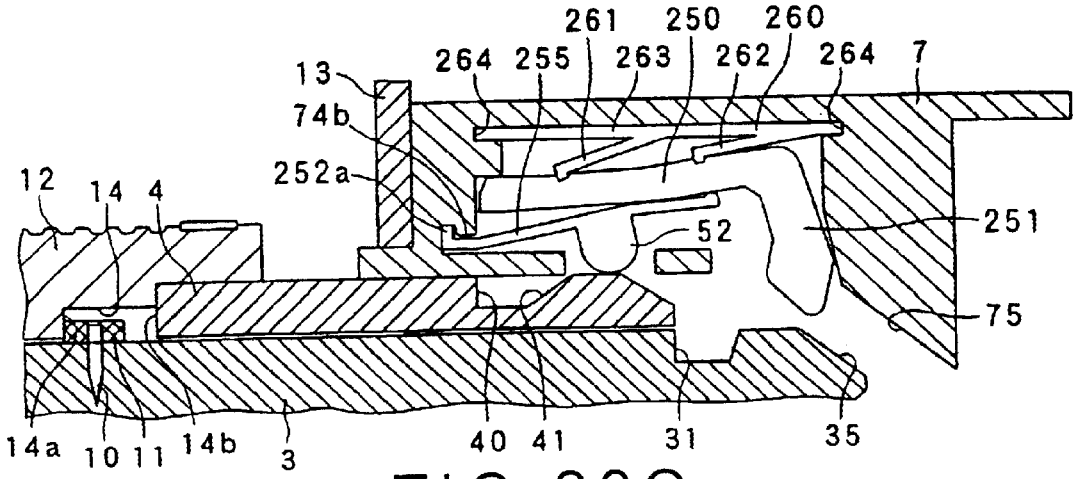

When the optical cable 2 is further pulled out from this state, the connector plug 3 moves in the extracting direction indicated by an arrow G2 in FIG. 29C while flexing the plug engagement pawl 251, and the unlocking member 4 moves in the same direction. As the unlocking member 4 moves integrally with the connector plug 3 in the extracting direction indicated by the arrow G2 in FIG. 29C, the press operator 52 of the movement control member 252 is pushed up over the inclined surface portion 41 of the cam groove 40 and the lock member 150 is turned in the direction of an arrow S1 in FIG. 29C, thus detaching the plug engagement pawl 251 on the distal end side from the connector plug 3. As the plug engagement pawl 251 is detached from the engagement pawl engagement groove 31 of the connector plug 3, the plug unit P is unlocked from the receptacle unit R, thus enabling extraction of the plug unit P from the receptacle unit R.

In this manner, even if the optical cable 2 is pulled out, the pulling force is absorbed by the elastic displacement of the plug engagement pawl 251 of the lock member 250 and the connector plug 3 is unlocked to enable extraction of the plug unit P from the receptacle unit R. Therefore, it is possible to safely pull out the plug unit P from the receptacle unit R even when an erroneous operation is carried out.

Industrial Applicability

As described above, in the connection device according to the present invention, the connector plug of the plug unit is locked by the lock member and the rotation of the lock member is controlled by the cam portion provided on the unlocking member. Therefore, the pivotal point of the lock member can be moved and the plug engagement pawl provided at the distal end of the lock member can be moved substantially perpendicularly to the connector plug so as to be engaged with and disengaged from the engagement groove provided on the connector plug. Thus, the connector plug can be securely held at a predetermined position.

Moreover, the Z spring, which is an energizing force for generating an energizing force to energize the lock member into the direction orthogonal to the axial direction of the cable and an energizing force to energize the lock member into the axial direction of the cable or an oblique forward direction to the axial direction of the cable, is used as the spring for energizing the lock member. Therefore, the tapered portion on the distal end side of the connector plug can be pressed in tight contact with the tapered portion on the receptacle side for receiving the former tapered portion. Thus, the inserting position of the connector plug with respect to the receptacle can be accurately determined and transmission of signals with good transfer characteristics can be carried out.

What is claimed is:

1. A connection device including a plug unit having a connector plug provided at an end portion of a signal cable and an unlocking member supported on an outer circumferential surface of the connector plug so as to be movable by a predetermined distance in an axial direction of the cable and having a knob portion mounted thereon, and a receptacle unit in which the plug unit can be inserted and removed, the connection device comprising a lock member housed in the receptacle unit and adapted for being engaged with the connector plug to lock the plug unit and being controlled by movement of the unlocking member in the axial direction of the cable via a cam portion provided on an outer circumferential surface of the unlocking member, wherein when the lock member is rotationally controlled by the movement of the unlocking member in the axial direction of the cable, the lock member is housed in a lock member housing portion provided in the receptacle unit, with a pivotal point position of the lock member being movable.

2. The connection device as claimed in claim 1, further comprising a plug engagement pawl and a regulating means for being abutted against a part of the lock member and regulating a range of movement of the lock member provided in the lock member housing portion, at a position near the pivotal point position of the lock member and near the plug engagement pawl.

3. The connection device as claimed in claim 1, further comprising a spring-lock member, wherein an engagement portion of the spring-lock member having a proximal portion thereof attached to the receptacle is projected into a locus when the unlocking member is moved, and the engagement portion presses an inclined surface portion of the cam portion provided on the outer circumferential surface of the unlocking member when the plug unit is inserted.

4. The connection device as claimed in claim 1, wherein the connector plug has a tapered portion provided at a distal end thereof, the tapered portion being engaged with a tapered portion provided in the receptacle unit.

5. The connection device as claimed in claim 1, further comprising a plug engagement pawl provided at a distal end of the lock member, the plug engagement pawl being engaged with the connector plug, wherein the plug engagement pawl is elastically displaceable.

6. The connection device as claimed in claim 4, wherein the lock member is made of an elastically displaceable synthetic resin.

7. The connection device as claimed in claim 1, wherein the signal cable is an optical cable.

8. A connection device including a plug unit having a connector plug provided at an end portion of a signal cable and an unlocking member supported on an outer circumferential surface of the connector plug so as to be movable by a predetermined distance in an axial direction of the cable and having a knob portion mounted thereon, and a receptacle unit in which the plug unit can be inserted and removed, the connection device comprising a lock member housed in the receptacle unit and adapted for being engaged with the connector plug to lock the plug unit and being controlled by movement of the unlocking member in the axial direction of the cable via a cam portion provided on an outer circumferential surface of the unlocking member; and an elastic member having one end held by the receptacle unit and having an other end held by the lock member, the elastic member being adapted for applying to the lock member an energizing force in a direction parallel to the axial direction of the cable and an energizing force in a direction perpendicular to the axial direction of the cable.

9. The connection device as claimed in claim 8, wherein the elastic member is a plate-like Z spring molded integrally with the lock member.

10. The connection device as claimed in claim 8, wherein the elastic member is a Z spring formed by bending a thin plate in a Z-shape.

11. The connection device as claimed in claim 8, wherein the elastic member is a spring having a thin pipe-like cross section, including a moving pin provided parallel to a direction of a width of the lock member and a fixed pin formed parallel to the moving pin, said moving pin and said fixed pin being inserted in a hollow part of the spring.

12. The connection device as claimed in claim 8, further comprising a lock member housing portion housing said lock member, a protruding guide pin formed on both surfaces in a direction of a width of the lock member, and a groove having a recessed closed route formed on corresponding wall surfaces of the lock member housing portion, so that the guide pin is engaged with the groove to guide the lock member to a predetermined position in accordance with the movement of the lock member.

13. The connection device as claimed in claim 8, further comprising a plug engagement pawl, wherein the lock member has a protrusion formed thereon protruding from one lateral side of the plug engagement pawl, and a rotatably supported rotator is accommodated on a wall surface of the lock member housing portion, so that a position where the protrusion is abutted against the rotator is changed according to the movement of the lock member, thereby guiding the lock member to a predetermined position.

14. A connection device including a plug unit that has a connector plug provided at an end portion of a signal cable, and an unlocking member supported on an outer circumferential surface of the connector plug so as to be movable by a predetermined distance in an axial direction of the cable and having a knob portion mounted thereon, and a receptacle unit in which the plug unit can be inserted and removed, the connection device comprising:

a lock member housed in the receptacle unit and adapted for being engaged with the connector plug to lock the plug unit; and a movement control member for controlling movement of the lock member by movement of the unlocking member in the axial direction of the cable via a cam portion provided on an outer circumferential surface of the unlocking member, wherein when the lock member is rotationally controlled by a rotation of the movement control member due to the movement of the unlocking member in the axial direction of the cable, the lock member is housed in a lock member housing portion provided in the receptacle unit, with a pivotal point position of the lock member being movable.

15. The connection device as claimed in claim 14, further comprising a plug engagement pawl provided at a distal end of the lock member, the plug engagement pawl being engaged with the connector plug, wherein the plug engagement pawl is elastically displace able.

16. The connection device as claimed in claim 14, wherein the lock member is made of an elastically displaceable synthetic resin.

17. The connection device as claimed in claim 14, wherein the connector plug has a tapered portion provided at a distal end thereof, the tapered portion being engaged with a tapered portion provided in the receptacle unit.

* * * * *